US007893879B2

(12) United States Patent
Noro et al.

(10) Patent No.: US 7,893,879 B2
(45) Date of Patent: Feb. 22, 2011

(54) ANTENNA APPARATUS

(75) Inventors: Junichi Noro, Akita (JP); Akira Yoneya, Akita (JP); Isao Fukae, Tokyo (JP); Tomohiro Shinkawa, Tokyo (JP); Kazunari Saito, Akita (JP); Akira Miyoshi, Tokyo (JP); Satoshi Kohno, Akita (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 693 days.

(21) Appl. No.: 11/858,253

(22) Filed: Sep. 20, 2007

(65) Prior Publication Data

US 2008/0074327 A1 Mar. 27, 2008

(30) Foreign Application Priority Data

Sep. 21, 2006 (JP) ..... P2006-255904
Sep. 21, 2006 (JP) ..... P2006-255933
Oct. 2, 2006 (JP) ..... P2006-270929
Jul. 12, 2007 (JP) ..... P2007-183668

(51) Int. Cl.
*H01Q 1/38* (2006.01)

(52) U.S. Cl. ..... 343/700 MS; 343/846; 343/848

(58) Field of Classification Search ..... 343/700 MS, 343/846, 848
See application file for complete search history.

(56) References Cited

U.S. PATENT DOCUMENTS 6,972,720 B2 * 12/2005 Shikata et al. ..... 343/700 MS
7,075,486 B2 * 7/2006 Suzuki ..... 343/700 MS
2005/0093748 A1 * 5/2005 Yuanzhu ..... 343/700 MS
2005/0116875 A1 * 6/2005 Yuanzhu et al. ..... 343/846

FOREIGN PATENT DOCUMENTS

EP 831547 A2 * 3/1998
JP 2001 339232 12/2001
JP 2001-339233 12/2001
JP 2001-339234 12/2001
JP 2004 526379 8/2004
JP 2005-143027 6/2005
JP 2005 159945 6/2005
JP 2005 252585 9/2005
JP 2006222540 A * 8/2006

OTHER PUBLICATIONS

Japanese Offcie Action.

* cited by examiner

*Primary Examiner*—Douglas W Owens
*Assistant Examiner*—Dieu Hien T Duong
(74) *Attorney, Agent, or Firm*—Whitham Curtis Christofferson & Cook, PC

(57) ABSTRACT

An antenna apparatus includes: a circuit board that has a main surface and a rear surface opposite to each other; an antenna element that is formed of a metal plate and is arranged at a predetermined distance from the main surface of the circuit board; a plurality of legs that extend from the antenna element toward the circuit board; a ground conductor that is formed on the main surface or the rear surface of the circuit board; a feeding pin that supplies power from the circuit board to the antenna element; and a plurality of comb-shaped capacitor patterns that are formed on one of or both the main surface and the rear surface of the circuit board and are electrically connected between the plurality of legs and the ground conductor.

6 Claims, 13 Drawing Sheets

ANTENNA APPARATUS

BACKGROUND OF THE INVENTION

1. Technical Field of the Invention

The present invention relates to an antenna apparatus, and more particularly, to a small planar antenna apparatus used as a global positioning system (GPS) antenna.

2. Related Art

As known in this technical field, a GPS (global positioning system) measures the position of an object using a satellite. The GPS receives radio waves (GPS signals) from four or more satellites among 24 satellites that orbit the earth, measures the positional relationship between a moving object and the satellites and a time error therebetween using the received radio waves, and accurately calculates the position and altitude of the moving object on the map using triangulation.

In recent years, the GPS has come into widespread use for car navigation systems for detecting the position of a traveling vehicle. The car navigation system includes a GPS antenna for receiving GPS signals, a processing unit that processes the GPS signals received through the GPS antenna to detect the current position of a vehicle, and a display unit that displays the position detected by the processing unit on the map.

Meanwhile, in recent years, with the development of small communication apparatuses (for example, a GPS car navigation apparatus, a portable navigation apparatus, and a satellite receiver), such as mobile communication apparatuses, antenna apparatuses having a small size and a high performance have been demanded.

Among the antenna apparatuses, a planar antenna apparatus (for example, a circularly polarized wave patch antenna) has the advantages of a small thickness, a small size, and easy integration with a semiconductor circuit. Therefore, the planar antenna apparatus is widely used as an antenna for a small communication apparatus.

The planar antenna apparatus including a circularly polarized wave antenna element and a circuit board having a low noise amplifier (LNA) on a rear surface thereof has been proposed (for example, see Patent Documents 1, 3 and 4). The circularly polarized wave antenna element is composed of a so-called patch antenna element. The circularly polarized wave antenna element includes a dielectric substrate that is formed of a high dielectric material such as ceramic. A radiating element is provided on the front surface of the dielectric substrate, and a ground pattern is formed on the rear surface of the dielectric substrate. A pinhole is formed in the dielectric substrate so as to pass through the dielectric substrate from the front surface to the rear surface. A feeding pin for connecting the radiating element and the circuit board is inserted into the pinhole. In the planar antenna apparatus having the above-mentioned structure, the dielectric substrate formed of a high dielectric material makes it possible to ensure the capacitance of the antenna, and thus it is possible to lower a resonance frequency and reduce the size of the planar antenna apparatus.

As another planar antenna apparatus, a metal plate patch antenna having an antenna element (a radiating conductor plate) that is formed of a metal plate has been proposed. The metal plate patch antenna can be manufactured at a lower cost than a general planar antenna apparatus having a radiating conductor layer (radiating element) that is patterned on a dielectric substrate.

The metal plate patch antenna having the following structure has been proposed: it includes a ground conductor, a dielectric substrate (a circuit board) that has a plurality of solder lands and is provided on the ground conductor, a radiating conductor plate that is provided above the dielectric substrate (the circuit board) at a predetermined distance therefrom, and a plurality of legs that extend from the radiating conductor plate toward the dielectric substrate (the circuit board); and the plurality of legs are soldered to the corresponding solder lands to support the radiating conductor plate (for example, see Patent Document 2). In the planar antenna apparatus (the metal plate patch antenna) having the above-mentioned structure, the plurality of legs extending from the radiating conductor plate toward the dielectric substrate (the circuit board) are soldered to the solder lands, and the solder lands are opposite to the ground conductor with the dielectric substrate (the circuit board) interposed therebetween. Therefore, capacitors are formed by capacitances between the solder lands and the ground conductor. As a result, the resonance frequency is lowered, and thus it is possible to reduce the size of the radiating conductor plate.

[Patent Document 1] JP-A-2001-339232

[Patent Document 2] JP-A-2005-143027

[Patent Document 3] JP-A-2001-339233

[Patent Document 4] JP-A-2001-339234

However, the high dielectric material, such as ceramic, is heavy and expensive. Therefore, as described in Patent Documents 1, 3 and 4, when the high dielectric material, such as ceramic, is mounted on a small planar antenna apparatus, the overall weight of the antenna apparatus increases, and the manufacturing costs thereof also increase.

Meanwhile, in the planar antenna apparatus (the metal plate patch antenna) disclosed in Patent Document 2, the size of the radiating conductor plate is reduced, but the capacitance value changes due to a variation in the amount of solder used and a variation in soldering area. As a result, the planar antenna apparatus (the metal plate patch antenna) disclosed in Patent Document 2 has problems in that the antenna resonance frequency varies and stable frequency characteristics are not obtained.

In addition, electrodes (lands) may be formed on the front surface (main surface) and the rear surface of the circuit board in order to increase the capacitance. However, in this structure, it is necessary to increase the areas of the electrodes (lands) in order to increase the capacitance value and improve the effect of shortening a wavelength, which results in an increase in the size of the substrate.

SUMMARY

Accordingly, an object of the invention is to provide an antenna apparatus having a small size, light weight, a low manufacturing cost, and sufficient capacitance.

Another object of the invention is to provide an antenna apparatus capable of preventing a variation in antenna resonance frequency and obtaining stable frequency characteristics.

According to a first aspect of the invention, an antenna apparatus (10) includes: a circuit board (20; 20A) that has a main surface (20*a*) and a rear surface (20*b*) opposite to each other; an antenna element (50) that is formed of a metal plate and is arranged at a predetermined distance from the main surface of the circuit board; a plurality of legs (60) that extend from the antenna element toward the circuit board; a ground conductor (21) that is formed on the main surface or the rear surface of the circuit board; a feeding pin (30) that supplies power from the circuit board to the antenna element; and a plurality of comb-shaped capacitor patterns (40) that are formed on one of or both the main surface and the rear surface of the circuit board and are electrically connected between the plurality of legs and the ground conductor.

The antenna apparatus according to the above-mentioned aspect, preferably, the plurality of legs (60) are arranged so as to be symmetric with respect to a center of the antenna element (50), and the plurality of comb-shaped capacitor patterns (40) are provided so as to correspond to the plurality of legs (60). The ground conductor (21) may be formed on the main surface (20*a*) of the circuit board (20). In this case, the antenna apparatus (10) may include a low noise amplifier (70) that is formed on the rear surface (20*b*) of the circuit board (20). The plurality of comb-shaped capacitor patterns (40) may be formed on both the main surface (20*a*) and the rear surface (20*b*) of the circuit board (20), or it may be formed on the rear surface (20*b*) of the circuit board (20A).

However, the numerical numbers in parentheses are given for the purpose of better comprehension of the invention, but are just illustrative examples. The invention is not limited thereto.

The antenna apparatus according to the above-mentioned aspect of the invention does not use a high dielectric material, such as ceramic, and includes an antenna element, a circuit board, a ground conductor, and a feeding pin. Therefore, it is possible to reduce the number of parts, the size and weight of the apparatus, and manufacturing costs thereof. In addition, since the ground conductor and the legs of the antenna element are electrically connected to each other through the comb-shaped capacitor patterns, it is possible to ensure sufficient capacitance without using a high dielectric material such as ceramic. Further, since the comb-shaped capacitor patterns are provided in order to ensure the capacitance, is it possible to arbitrarily set the capacitance value. Furthermore, since the comb-shaped capacitor patterns, not chip capacitors, are used, it is possible to prevent a variation in capacitance, and thus prevent a variation in antenna resonance frequency. As a result, it is possible to obtain stable frequency characteristics.

In order to achieve at least one of the above-mentioned object, according to a second aspect of the invention, an antenna apparatus includes: a dielectric substrate; an antenna element that is formed of a metal plate and is arranged at a predetermined distance from the dielectric substrate; a plurality of legs that extend from the antenna element toward the circuit board; and chip capacitors each of which is electrically connected to one of the plurality of legs and the dielectric substrate.

According to the second aspect of the invention, the dielectric substrate and the legs of the antenna element are electrically connected to each other through the chip capacitors.

According to the second aspect of the invention, the antenna apparatus includes the antenna element and the dielectric substrate without using a high dielectric material, such as ceramic. Therefore, it is possible to reduce the number of parts, the size and weight of the apparatus, and the manufacturing costs of the apparatus.

Further, the dielectric substrate and the legs of the antenna element are connected to each other through the chip capacitors. Therefore, it is possible to ensure sufficient capacitance without using a high dielectric material, such as ceramic.

In the antenna apparatus according to the second aspect, preferably, the plurality of legs are arranged so as to be symmetric with respect to a center of the antenna element, and the chip capacitors are provided so as to correspond to the plurality of legs.

According to the antenna apparatus, the chip capacitors are provided so as to correspond to the legs that are symmetric with respect to the center of the antenna element, and the legs are electrically connected to the dielectric substrate through the corresponding chip capacitors.

According to the antenna apparatus, since the legs are symmetric with respect to the center of the antenna element, the performance of the antenna apparatus is stabilized. In addition, since the chip capacitors are provided so as to correspond to the legs, it is possible to ensure sufficient capacitance without using a high dielectric material, such as ceramic. Further, since the chip capacitors are symmetrically arranged, the performance of the antenna apparatus is stabilized.

In the antenna apparatus according to the second aspect, preferably, a conductor layer having a circuit formed thereon and conductive portions insulated from the conductor layer are provided on the dielectric substrate, and one end of each of the legs is connected to the corresponding conductive portion. In addition, preferably, each of the chip capacitors is provided so as to be connected to both one end of the conductive portion and the conductor layer.

According to the antenna apparatus, the ends of the legs are connected to the corresponding conductive portions formed on the dielectric substrate, and the legs are electrically connected to the conductor layer through the chip capacitors that are provided so as to be connected to one end of each of the conductive portions and the conductor layer.

According to the antenna apparatus, the legs of the antenna element are electrically connected to the conductor layer of the dielectric substrate through the chip capacitors. Therefore, it is possible to ensure sufficient capacitance without using a high dielectric material, such as ceramic.

In the antenna apparatus according to the second aspect, preferably, insulating portions are provided between the conductive portions and the conductor layer of the dielectric substrate, and the conductive portion is surrounded by the insulating portion.

According to the antenna apparatus, the conductive portions and the conductor layer of the dielectric substrate are insulated from each other by the insulating portions.

According to the antenna apparatus, since the conductive portions and the conductor layer of the dielectric substrate are insulated from each other by the insulating portions, it is possible to reliably insulate the conductive portions from the conductor layer.

In order to achieve at least one of the above-mentioned object, according to a third aspect of the invention, an antenna apparatus includes: a dielectric substrate that has a conductor layer on one surface; an antenna element that is formed of a metal plate and is arranged at a predetermined distance from the dielectric substrate; and a plurality of legs that extend from the antenna element toward the dielectric substrate. In the antenna apparatus, the legs have bent portions facing the dielectric substrate with a predetermined gap interposed therebetween at leading ends thereof.

According to the third aspect of the invention, capacitors are formed between the dielectric substrate and the bent portions that are provided at the ends of the legs so as to face the dielectric substrate.

According to the third aspect of the invention, a wavelength can be reduced, and thus it is possible to reduce the size of an antenna apparatus.

In addition, since the dielectric substrate is coupled to the antenna element by a method that does not affect a capacitance value unlike soldering, it is possible to prevent a variation in capacitance and thus stabilize frequency characteristics of an antenna apparatus.

Preferably, the antenna apparatus further includes chip capacitors each of which is provided on the dielectric substrate so as to be electrically connected to one of the legs.

According to the antenna device, the dielectric substrate and the legs of the antenna element are electrically connected to each other by the chip capacitors.

According to the antenna device, since the dielectric substrate is connected to the legs of the antenna element by the chip capacitors, it is possible to shorten a wavelength without increasing the size of a substrate, and thus reduce the size of an antenna apparatus.

Preferably, the antenna apparatus further includes a holder that is provided between the bent portions and the dielectric substrate.

According to the antenna apparatus, since the holder is interposed between the bent portions and the dielectric substrate, it is possible to firmly support the antenna element.

According to the antenna device, it is possible to reinforce the mechanical strength of an antenna apparatus.

In the antenna apparatus, preferably, the holder is formed of a dielectric resin.

According to the antenna apparatus, since the holder is formed of a material having a dielectric constant, the holder can be used as a dielectric material.

According to the antenna apparatus, since the holder is formed of a material having a dielectric constant, it is possible to use the holder as a dielectric material in addition to a member for fixing the bent portions.

In order to achieve at least one of the above-mentioned object, according to a fourth aspect of the invention, an antenna apparatus includes: a dielectric substrate; an antenna element that is formed of a metal plate and is arranged at a predetermined distance from the dielectric substrate; and a plurality of legs that extend from the antenna element toward the dielectric substrate and include fixing portions passing through the dielectric substrate. In the antenna apparatus, the antenna element is fixed to the dielectric substrate by twisting the fixing portions.

According to the fourth aspect of the invention, the fixing portions of the legs passing through the dielectric substrate are twisted to fix the antenna element to the dielectric substrate. Therefore, it is possible to couple the antenna element to the dielectric substrate without increasing the number of parts.

According to the antenna apparatus, the antenna element and the dielectric substrate are integrated into one body, and thus a variation in capacitance is reduced. As a result, it is possible to stabilize frequency characteristics of an antenna apparatus.

In addition, since the number of parts does not increase, it is possible to manufacture an inexpensive antenna apparatus.

The antenna apparatus, preferably, further includes chip capacitors each of which is provided on the dielectric substrate so as to be electrically connected to one of the legs.

According to the antenna apparatus, the dielectric substrate and the legs of the antenna element are electrically connected to each other by the chip capacitors.

According to the antenna apparatus, since the dielectric substrate is connected to the legs of the antenna element by the chip capacitors, it is possible to shorten a wavelength without increasing the size of a substrate, and thus reduce the size of an antenna apparatus.

In the antenna apparatus, preferably, the width of the fixing portion is larger than that of the leg.

According to the antenna apparatus, since the width of the fixing portion of the leg passing through the dielectric substrate is larger than the width of the leg, large fixing portions for coupling the dielectric substrate to the antenna element are formed.

According to the antenna apparatus, since the fixing portions for fixing the antenna element to the dielectric substrate have a large size, it is possible to manufacture an antenna apparatus having improved coupling strength.

In the antenna apparatus, preferably, the fixing portion has a cut-out portion, and the fixing portion is twisted at the cut-out portion.

According to the antenna apparatus, since each fixing portion has the cut-out portion, it is possible to keep a constant distance between the dielectric substrate and the antenna element.

According to the antenna apparatus, it is possible to maintain a constant distance between the antenna element and the dielectric substrate. As a result, it is possible to easily manufacture an antenna apparatus.

DETAILED DESCRIPTION OF THE INVENTION

Hereinafter, exemplary embodiments of the invention will be described in detail with reference to the accompanying drawings.

First Embodiment

Figure 1:
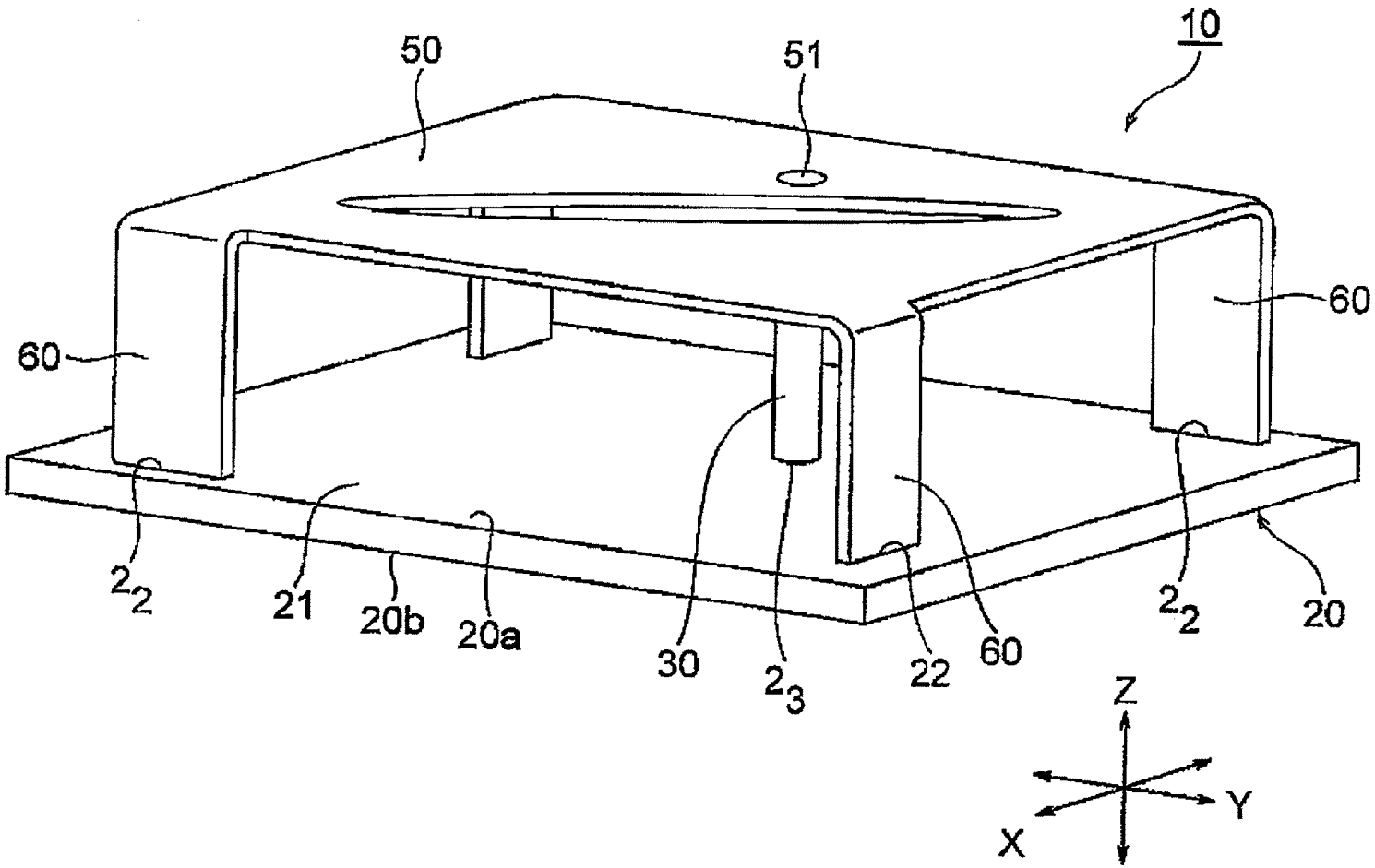
FIG. 1 is a perspective view illustrating an antenna apparatus according to a first embodiment of the invention.
Figure 2:
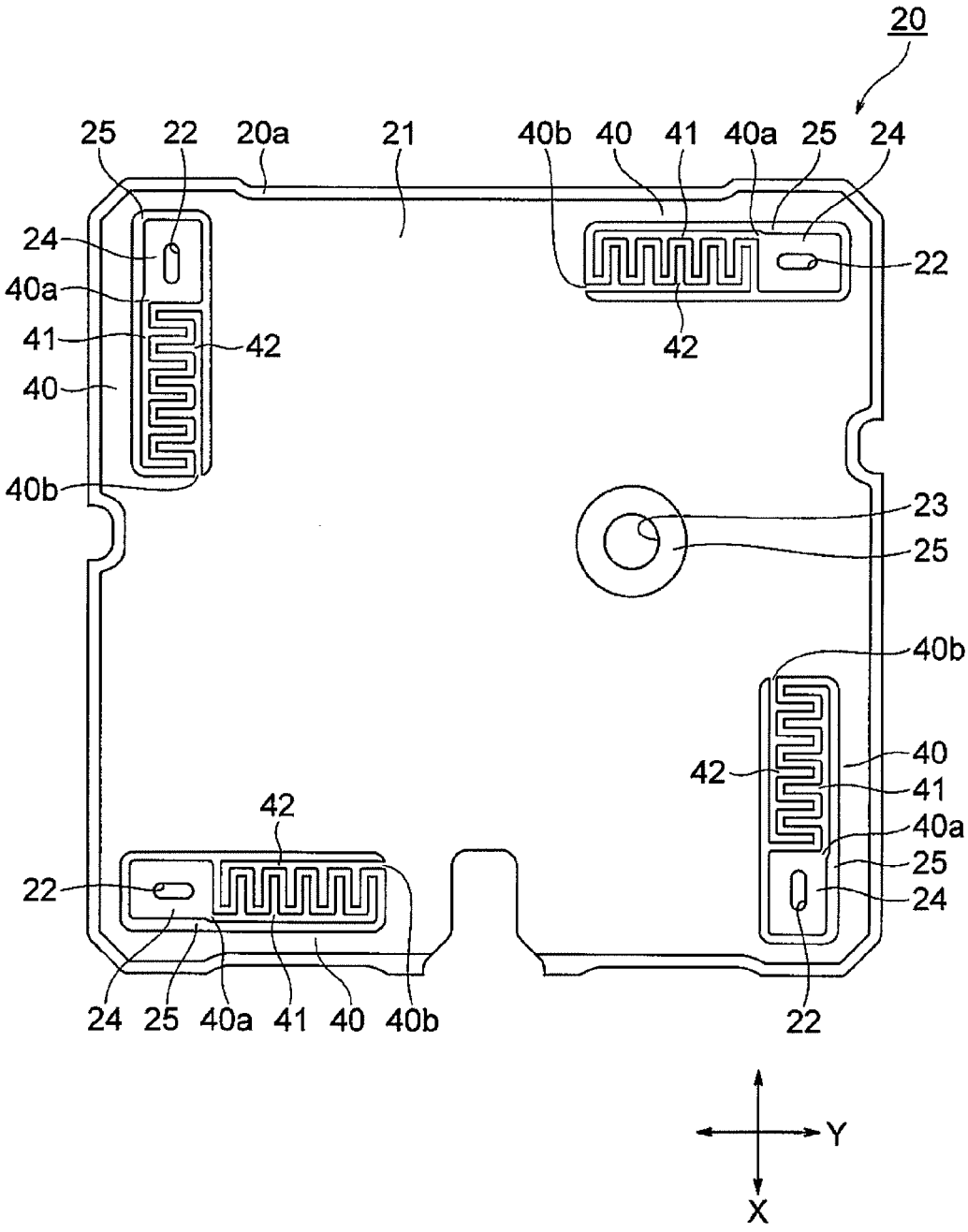
FIG. 2 is a plan view (top view) illustrating a circuit board used for the antenna apparatus shown in FIG. 1.
Figure 3:
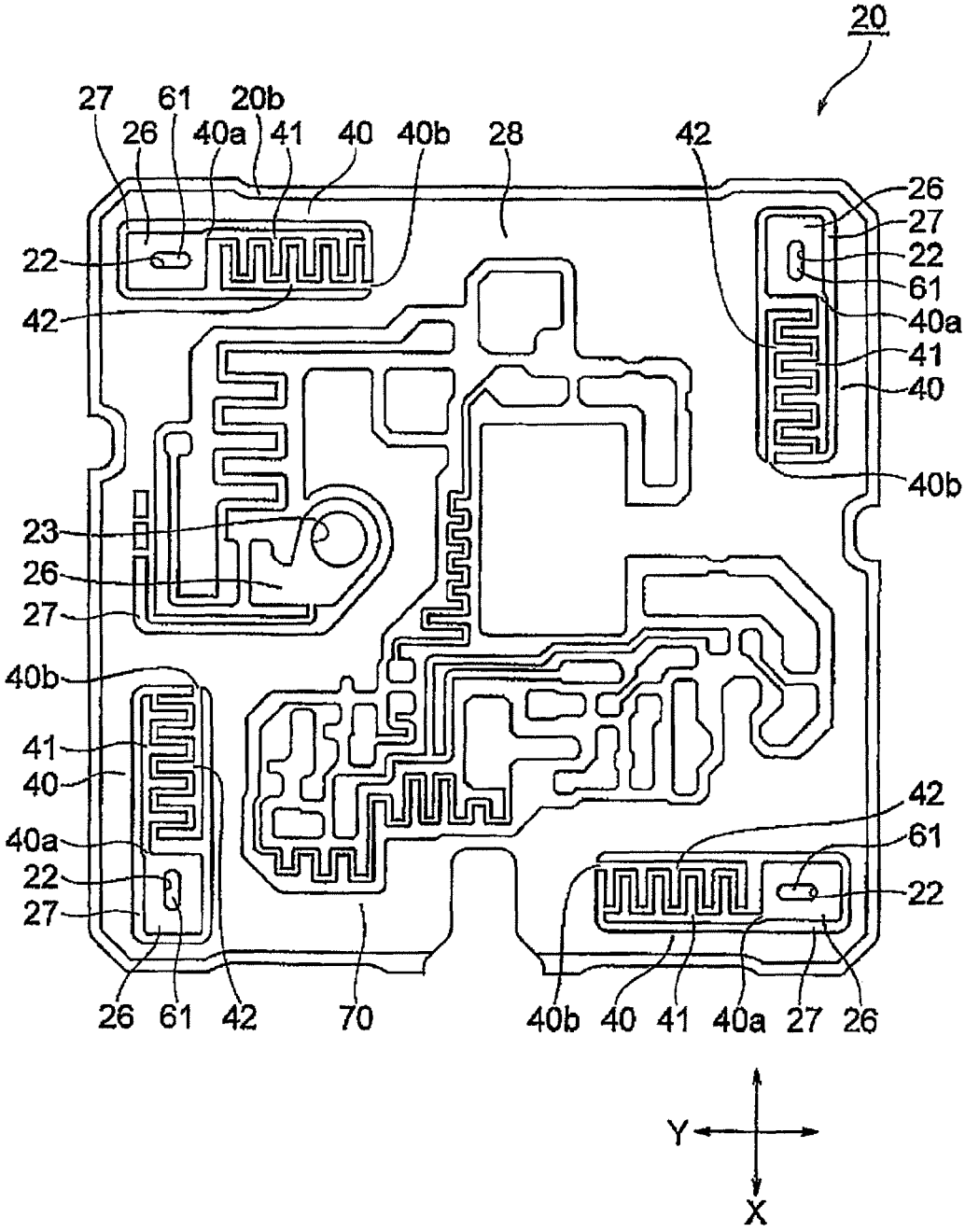
FIG. 3 is a bottom view illustrating the circuit board used for the antenna apparatus shown in FIG. 1.

An antenna apparatus 10 according to a first embodiment of the invention will be described with reference to FIGS. 1 and 2. FIG. 1 is a perspective view illustrating the antenna apparatus 10. FIG. 2 is a top view illustrating a circuit board 20 used for the antenna apparatus 10 shown in FIG. 1, and FIG. 3 is a bottom view illustrating the circuit board 20. In FIGS. 1 to 3, forward and backward directions (a depth direction) indicate an X-axis direction, a horizontal direction (a width direction) indicates a Y-axis direction, and a vertical direction (a height direction or a thickness direction) indicates a Z-axis direction. The antenna apparatus 10 shown in FIGS. 1 to 3 is a GPS antenna for receiving GPS signals from GPS satellites.

As shown in FIG. 1, the antenna apparatus 10 includes the circuit board 20 having a conductor layer 21, such as a copper-clad film, on an upper surface (the main surface) 20*a*. The conductor layer 21 serves as a ground conductor. The circuit board 20 is formed in a substantially rectangular shape. Four clearance holes 22 are provided in the vicinities of four corners of the circuit board 20. In addition, an insertion hole 23 into which a feeding pin 30 is inserted is provided at a position that slightly deviates from the center of the circuit board 20.

As shown in FIG. 2, conductive portions 24 are provided in the circumferences of the corresponding clearance holes 22 so as to surround the clearance holes 22 on the upper surface (the main surface) 20*a* of the circuit board 20. Insulating portions 25 are provided in the peripheries of the conductive portions 24 and the circumference of the insertion hole 23 so as to surround the conductive portions 24 and the insertion hole 23.

Meanwhile, as shown in FIG. 3, conductive portions 26 are provided in the circumferences of the clearance holes 22 and the circumference of the insertion hole 23 so as to surround the clearance holes 22 and the insertion hole 23 on a lower surface (a rear surface) 20*b* of the circuit board 20. Insulating portions 27 are provided in the peripheries of the corresponding conductive portions 26 so as to surround the conductive portions 26. The periphery of each of the insulating portions 27 is covered with a conductor layer 28, and a circuit element, such as a low noise amplifier (LNA) 70, is mounted on the conductor layer 28.

As shown in FIG. 2, comb-shaped capacitor patterns 40 are provided on the upper surface (the main surface) 20*a* of the circuit board 20 so as to be connected to one end of each of the conductive portions 24. Each of the comb-shaped capacitor patterns 40 is provided such that one end 40*a* thereof is connected to the conductive portion 24 and the other end 40*b* is connected to the conductor layer (the ground conductor) 21, with the insulating portion 25 interposed therebetween. Specifically, each of the comb-shaped capacitor patterns 40 includes first and second comb-shaped patterns 41 and 42 that are opposite to each other with the insulating portion 25 interposed therebetween. The first comb-shaped pattern 41 is connected to the conductive portion 24 at the one end 40*a*, and the second comb-shaped pattern 42 is connected to the conductor layer (the ground conductor) 21 at the other end 40*b*. The comb-shaped capacitor pattern 40 is preferably arranged at a position where the one end 40*a* is connected to the conductive portion 24 and the other end 40*b* is connected to the conductor layer (the ground conductor) 21, with the insulating portion 25 interposed therebetween, but the position of the comb-shaped capacitor pattern 40 is not limited thereto.

Similarly, as shown in FIG. 3, comb-shaped capacitor patterns 40 are provided on the lower surface (the rear surface) 20*b* of the circuit board 20 so as to be connected to one end of each of the conductive portions 26. Each of the comb-shaped capacitor patterns 40 is provided such that one end 40*a* thereof is connected to the conductive portion 26 and the other end 40*b* is connected to the conductor layer 28, with the insulating portion 27 interposed therebetween. Specifically, each of the comb-shaped capacitor patterns 40 includes first and second comb-shaped patterns 41 and 42 that are opposite to each other with the insulating portion 27 interposed therebetween. The first comb-shaped pattern 41 is connected to the conductive portion 26 at the one end 40*a*, and the second comb-shaped pattern 42 is connected to the conductor layer 28 at the other end 40*b*. The comb-shaped capacitor pattern 40 is preferably arranged at a position where the one end 40*a* is connected to the conductive portion 26 and the other end 40*b* is connected to the conductor layer 28, with the insulating portion 27 interposed therebetween, but the position of the comb-shaped capacitor pattern 40 is not limited thereto.

The conductor layer (the ground conductor) 21 and the conductor layer 28 are electrically connected to each other by a plurality of through holes (not shown).

The feeding pin 30 is fitted to the insertion hole 23 of the circuit board 20 so as to pass through the circuit board 20. A lower end of the feeding pint 30 (an end protruding from the lower surface (the rear surface) 20*b* of the circuit board 20) is connected to an input unit of the low noise amplifier (LNA) 70. An output unit of the low noise amplifier (LNA) 70 is electrically connected to a central conductor of a coaxial cable (not shown). An outer conductor of the coaxial cable is electrically connected to the conductor layer 28. Signals are transmitted from the antenna apparatus 10 to an external receiving circuit through the coaxial cable.

A flat antenna element 50 is provided above the upper surface 20*a* of the circuit board 20 so as to be parallel to the circuit board 20 at a predetermined distance. The antenna element 50 is formed of a rectangular metal plate (for example, a copper plate) having a smaller size than the circuit board 20.

Legs 60 formed of a metal plate are provided in the vicinities of four corners of the antenna element 50 so as to extend toward the circuit board 20. The legs 60 are symmetric with respect to the center of the antenna element 50. For example, the legs 60 are integrally formed with the antennal element 50 by bending portions of the antenna element 50.

The legs 60 may be substantially symmetric with respect to the center of the antenna element 50. The number and shape of the legs 60 are not limited to those shown in FIG. 1.

As shown in FIGS. 2 and 3, ends of the plurality of legs 60 that face the circuit board 20 are fitted to the clearance holes 22 that are provided in the vicinities of the corners of the circuit board 20 so that the legs 60 pass through the circuit board 20 from the upper surface (the main surface) 20*a* to the lower surface (the rear surface) 20*b*.

As described above, the edges of the clearance holes 22 are surrounded by the conductive portions 26 on the lower surface (the rear surface) 20*b* of the circuit board 20, and portions (hereinafter, referred to as fixing portions) 61 of the legs 30 protruding from the lower surface (the rear surface) 20*b* of the circuit board 20 are connected to the conductive portions 26 and are fixed thereto by soldering. The fixing portions 61 may be fixed so as not to come out from the clearance holes 22, and the fixing portions may be fixed by various methods other than soldering.

As described above, each of the comb-shaped capacitor patterns 40 is provided so as to be connected to both the conductive portion 26 and the conductor layer 28. The fixing portion 61 of each of the legs 60 is fixed so as to be connected to the conductive portion 26. The conductor layer 28 and the conductor layer (the ground conductor) 21 are electrically connected to each other by a through hole. Similarly, each of the comb-shaped capacitor patterns 40 is provided at a position where the conductive portion 24 and the conductor layer (the ground conductor) 21 are connected to each other. The fixing portion 61 of each of the legs 60 is connected to the conductive portion 24. Therefore, the fixing portion 61 of each of the legs 60 is electrically connected to the conductor layer (the ground conductor) 21 of the circuit board 20 through the comb-shaped capacitor pattern 40.

In addition, a feeding point 51 is provided at a position that slightly deviates from the center of the antennal element 50. An upper end of the feeding pin 30 passing through the circuit board 20 is soldered to the feeding point 51.

Next, the operation of the antenna apparatus 10 according to this embodiment of the invention will be described below.

In the antenna apparatus 10 according to this embodiment of the invention, the ends of the plurality of legs 60 that are integrally formed with the antenna element 50 are fitted to the clearance holes 22 provided in the circuit board 20, and portions (fixing portions) 61 of the legs 60 protruding from the lower surface of the circuit board 20 are soldered and fixed to the corresponding conductive portions 26 that are provided on the lower surface 20*b* of the circuit board 20. In this way, the fixing portions 61 are fixed to the circuit board 20 without coming out from the clearance holes 22. In addition, the fixing portions 61 of the legs 60 are electrically connected to the conductor layer (ground conductor) 21 of the circuit board 20 through the comb-shaped capacitor patterns 4 that are provided at positions where one end of each of the conductive portions 26 and the conductor layer 28 are connected to each other and positions where one end of each of the conductive portions 24 and the conductor layer (ground conductor) 21 are connected to each other.

Further, one end (lower end) of the feeding pin 30 to be connected to the input unit of the low noise amplifier (LNA) 70 that is formed on the rear surface (lower surface) 20*b* of the circuit board 20 is inserted into the insertion hole 23 of the circuit board 20, and the other end (upper end) of the feeding pint 30 is soldered to the feeding point 51 of the antenna element 50 In this way, the feeding pin 30 passes through the circuit board 20 and is connected to the antenna element 50, without being electrically connected to the conductor layer (ground conductor) 21 that is formed on the upper surface (the main surface) 20*a* of the circuit board 20.

Power is supplied to the antenna element 50 through the feeding pin 30. Meanwhile, when the antenna element 50 receives radio waves (GPS signals), the received signals are transmitted to an external receiving circuit through the low noise amplifier (LAN) 70 or the coaxial cable.

As described above, in the antenna apparatus 10 according to this embodiment of the invention, the antenna element 50 formed of a conductive plate, such as a metal plate, is connected to the circuit board 20, and the antenna apparatus 10 does not include a dielectric substrate that is formed of a high dielectric material, such as ceramic. Therefore, it is possible to decrease the number of parts and reduce the overall weight of the antenna apparatus. In addition, since the antenna apparatus does not use ceramic, which is a relatively expensive material, it is possible to reduce the manufacturing costs of the antenna apparatus.

Further, in the antenna apparatus 10 according to this embodiment of the invention, the fixing portions 61 of the legs 60 are electrically connected to the conductor layer (ground conductor) 21 formed on the upper surface 20*a* of the circuit board 20 by the comb-shaped capacitor patterns 40. In this way, it is possible to easily ensure large capacitance without increasing the size of the circuit board 20 and providing a dielectric substrate formed of a high dielectric material, such as ceramic. As a result, it is possible to reduce the size and weight of the antenna apparatus 10.

Furthermore, since the comb-shaped capacitor patterns 40, not chip capacitors, are used as capacitors, it is possible to prevent a variation in capacitance. As a result, it is possible to prevent a variation in the antenna resonance frequency of the antenna apparatus 10. In addition, it is possible to easily adjust a capacitance value.

Since the legs 60 are symmetric with respect to the center of the antenna element 50, the performance of the antenna apparatus 10 is stabilized. In addition, since the comb-shaped capacitor patterns 40 are provided so as to correspond to the legs 60, it is possible to ensure sufficient capacitance without using a high dielectric material such as ceramic. Since the comb-shaped capacitor patterns 40 are symmetrically provided, the performance of the antenna apparatus 10 is stabilized.

In this embodiment of the invention, the comb-shaped capacitor patterns 40 are provided on the upper surface 20*a* and the lower surface 20*b* of the circuit board 20, but the invention is not limited thereto.

Second Embodiment

Figure 4:
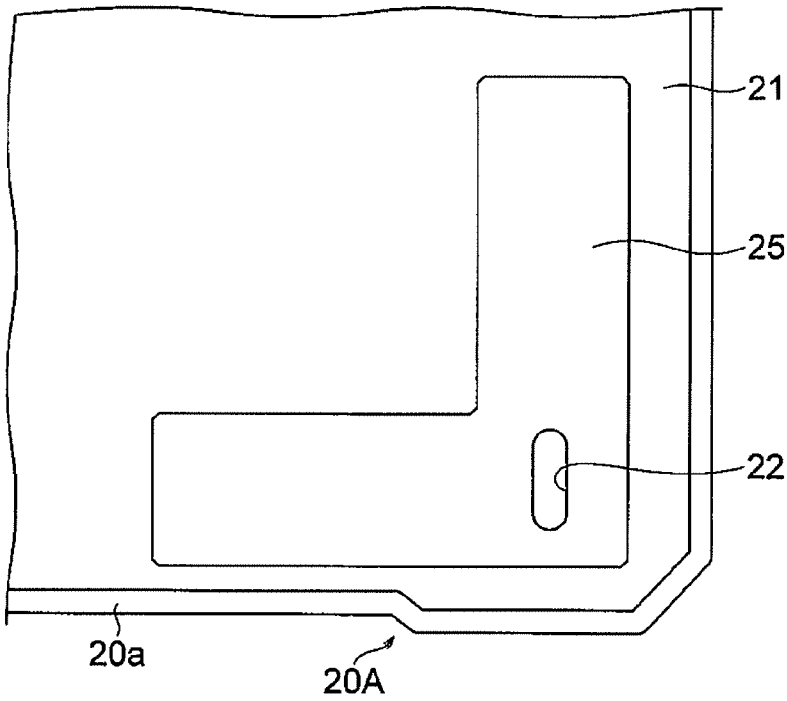
FIG. 4 is an enlarged top view (plan view) illustrating a corner of an upper surface of a circuit board used for an antenna apparatus according to a second embodiment of the invention.
Figure 5:
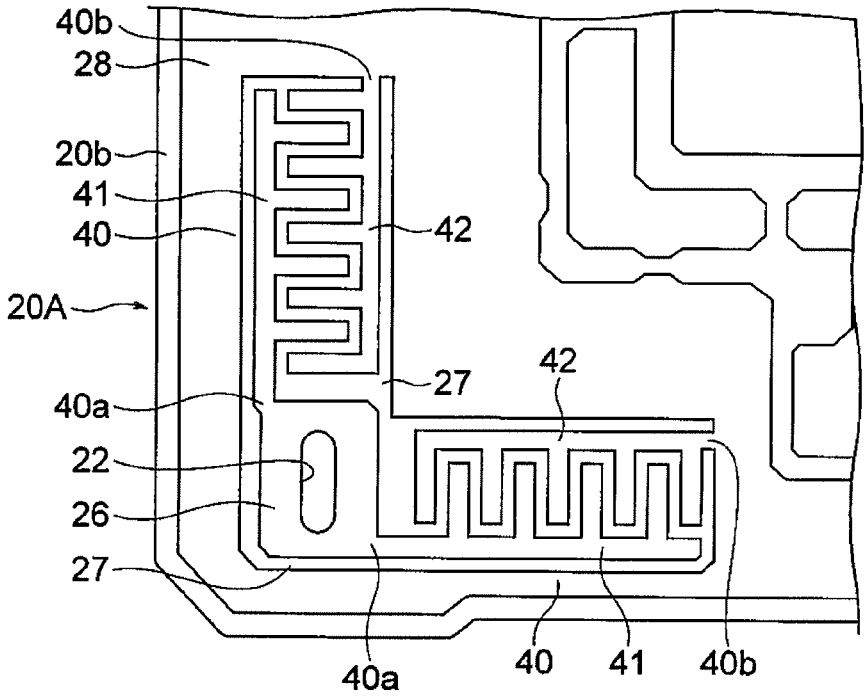
FIG. 5 is an enlarged bottom view illustrating a corner of a lower surface of the circuit board used for the antenna apparatus according to the second embodiment of the invention.

FIGS. 4 and 5 show a circuit board 20A that is used for an antenna apparatus according to a second embodiment of the invention. FIG. 4 is an enlarged top view (a plan view) illustrating a corner of an upper surface 20*a* of the circuit board 20A, and FIG. 5 is an enlarged bottom view illustrating a corner of a lower surface 20*b* of the circuit board 20A.

The circuit board 20A shown in FIGS. 4 and 5 has the comb-shaped capacitor patterns 40 on only the lower surface 20*b*, unlike the circuit board 20. In FIGS. 4 and 5, components having the same functions as those shown in FIGS. 2 and 3 are denoted by the same reference numerals.

As shown in FIG. 5, a pair of comb-shaped capacitor patterns 40 are provided so as to be connected to both ends of each conductive portion 26 on the lower surface (rear surface) 20*b* of the circuit board 20A. Each of the comb-shaped capacitor patterns 40 is arranged such that one end 40*a* thereof is connected to the conductive portion 26 and the other end 40*b* is connected to the conductor layer 28 with the insulating portion 27 interposed therebetween. Specifically, each of the comb-shaped capacitor patterns 40 includes the first and second comb-shaped patterns 41 and 42 that are opposite to each other with the insulating portion 27 interposed therebetween. The first comb-shaped pattern 41 is connected to the conductive portion 26 at the one end 40*a*, and the second comb-shaped pattern 42 is connected to the conductor layer 28 at the other end 40*b*. Each of the comb-shaped capacitor patterns 40 may be provided at a position where the one end 40*a* is connected to the conductive portion 26 and the other end 40*b* is connected to the conductor layer 28 with the insulating portion 27 interposed therebetween, but the position of each of the comb-shaped capacitor patterns 40 is not limited thereto.

As shown in FIG. 4, an insulating portion 25 is provided on the upper surface (the main surface) 20*a* of the circuit board at a position where the pair of comb-shaped capacitor patterns 40 are opposite to each other. That is, the insulating portion 25 is provided in the periphery of the corresponding clearance hole 22 so as to surround the clearance hole 22.

The antenna apparatus including the circuit board 20A having the above-mentioned structure has the same effects and operations as the antenna apparatus 10 according to the first embodiment of the invention.

Although exemplary embodiments of the invention have been described above, the invention is not limited thereto. In the above-described embodiments, the ground conductor 21 is formed on the upper surface (the main surface) 20*a* of the circuit board, but the invention is not limited thereto. For example, the ground conductor 21 may be formed on the lower surface (the rear surface) 20*b* of the circuit board. In this case, a circuit element, such as the low noise amplifier (LNA) 70, is mounted on the upper surface (the main surface) 20*a* of the circuit board. In addition, in the above-described embodiments, the comb-shaped capacitor patterns 40 are formed on both surfaces (the main surface and the rear surface) of the circuit board or only the rear surface 20*b* of the circuit board, but the invention is not limited thereto. For example, the comb-shaped capacitor patterns 40 may be formed on only the main surface 20*a* of the circuit board. Further, the comb-shaped capacitor patterns 40 may be covered with a resist (insulating film), or the resist covering the comb-shaped capacitor patterns 40 may be peeled off.

Third Embodiment

Hereinafter, a third embodiment of the invention will be described with reference to FIGS. 6 to 9. However, the scope of the invention is not limited thereto.

Figure 6:
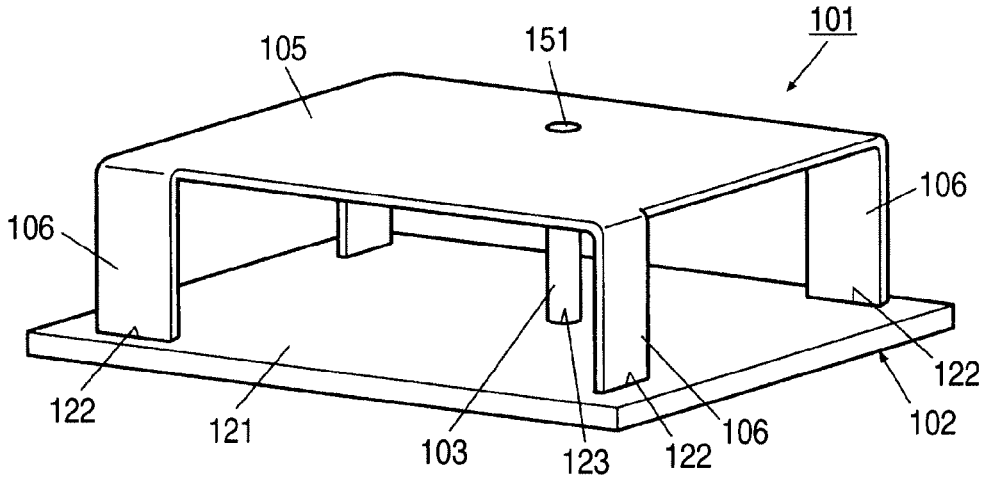
FIG. 6 is a perspective view illustrating an antenna apparatus according to a third embodiment of the invention.
Figure 7:
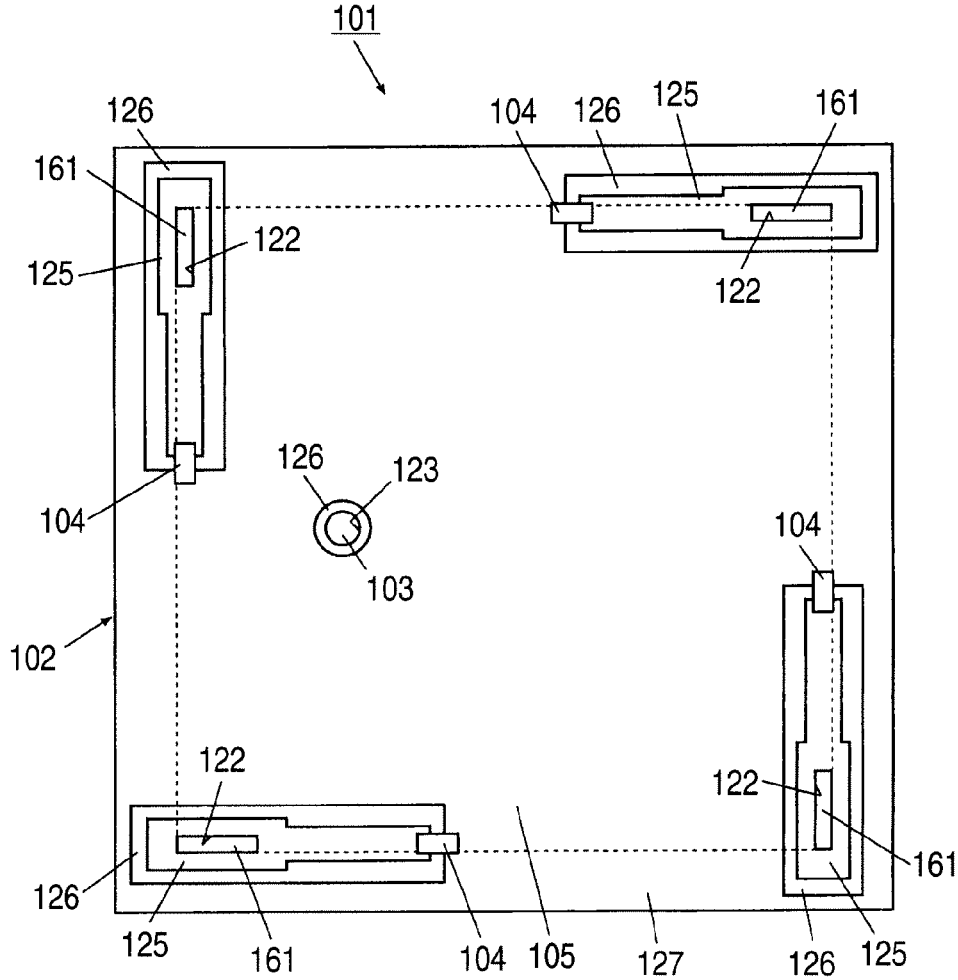
FIG. 7 is a bottom view illustrating the antenna apparatus shown in FIG. 6.
Figure 8:
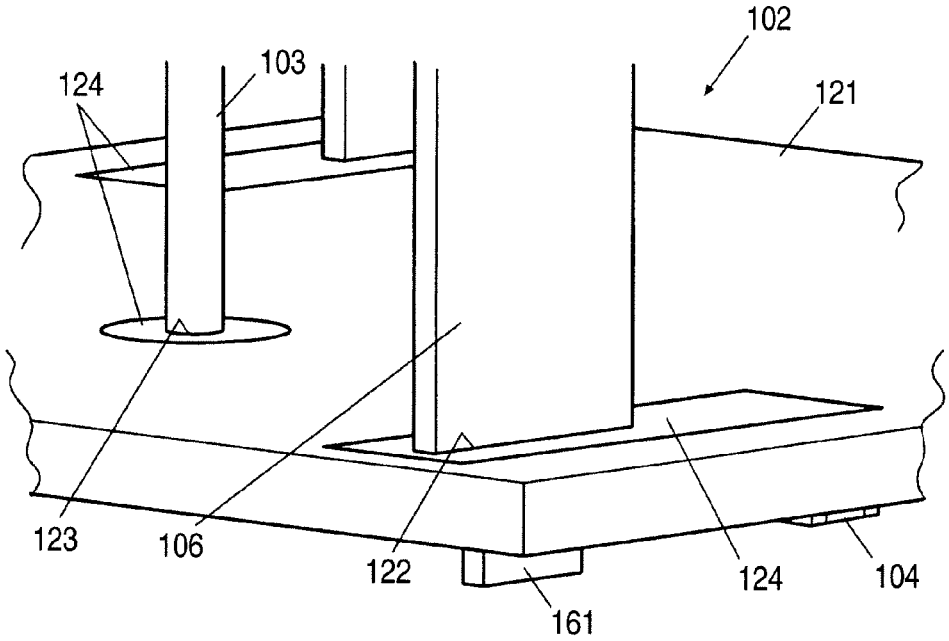
FIG. 8 is an enlarged view illustrating a portion of an upper surface of a dielectric substrate of the antenna apparatus shown in FIG. 6.

FIG. 6 is a perspective view illustrating an antenna apparatus 101 according to the third embodiment of the invention. FIG. 7 is a bottom view illustrating the antenna apparatus 101 shown in FIG. 6. FIG. 8 is an enlarged view illustrating a portion of an upper surface of a dielectric substrate of the antenna apparatus shown in FIG. 6, and FIG. 9 is an enlarged view illustrating a portion of a lower surface of the dielectric substrate of the antenna apparatus shown in FIG. 6.

As shown in FIGS. 6 and 7, the antenna apparatus 101 includes a dielectric substrate 102 having conductor layers 121, such as copper-clad films, on both surfaces. The dielectric substrate 102 is formed in a rectangular shape, and four clearance holes 122 are provided in the vicinities of four corners of the dielectric substrate 102. In addition, an insertion hole 123 into which a feeding pin 103, which will be described later, is inserted is provided at a position that slightly deviates from the center of the dielectric substrate 102.

As shown in FIG. 8, insulating portions 124 are provided in the circumferences of the clearance holes 122 and the insertion hole 123 on one surface (an upper surface in FIG. 6; which is simply referred to as an 'upper surface') of the dielectric substrate 102, and the clearance holes 122 and the insertion hole 123 are insulated from the conductor layer 121. Meanwhile, as shown in FIGS. 7 and 9, on the other surface (a lower surface FIG. 6; which is simply referred to as a 'lower surface') of the dielectric substrate 102, conductive portions 125 are provided in the circumferences of the corresponding clearance holes 122 so as to surround the clearance holes 122. Insulating portions 126 are provided in the peripheries of the conductive portions 125 and the circumference of the insertion hole 123 so as to surround the conductive portions 125 and the insertion hole 123. The peripheries of the insulting portions 126 are covered with a conductor layer 127, and for example, a circuit element, such as a low noise amplifier (LNA) (not shown), is mounted on the conductor layer 127.

Figure 9:
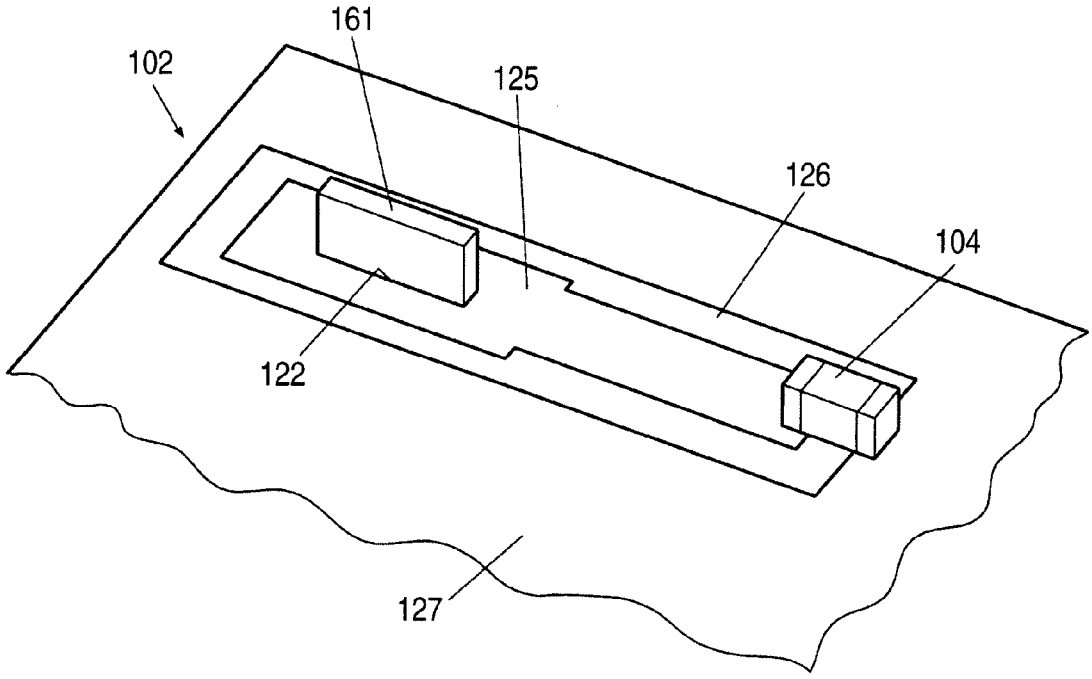
FIG. 9 is an enlarged view illustrating a portion of a lower surface of the dielectric substrate of the antenna apparatus shown in FIG. 6.

As shown in FIGS. 7 and 9, chip capacitors 104, serving as lumped-constant elements, are provided on the lower surface of the dielectric substrate 102 so as to be connected to one end of each of the corresponding conductive portions 125. The chip capacitor 104 is arranged such that one end thereof is connected to the conductive portion 125 and the other end is connected to the conductor layer 127, with the insulating portion 126 interposed therebetween.

For example, the chip capacitor 104 is a laminated ceramic chip capacitor formed by interposing a dielectric material, such as ceramic, between metal plates, but the invention is not limited thereto. Any type of chip capacitor can be used as long as it has a small size and light weight. In addition, the chip capacitor 104 may be arranged at a position where one end thereof is connected to the conductive portion 125 and the other end is connected to the conductor layer 127, with the insulating portion 126 interposed therebetween. However, the position of the chip capacitor 104 is not limited thereto.

Among the insulating portions 124 formed on the upper surface of the dielectric substrate 102, the length of the insulating portion 124 in the longitudinal direction that is provided in the circumference of the clearance hole 122 is substantially equal to that of the conductive portion 125 in the longitudinal direction that is provided on the lower surface of the dielectric substrate 102, and the insulating portion 124 provided in the circumference of the clearance hole 122 is opposite to the conductive portion 125. In this way, the conductive portion 125 is not opposite to the conductor layer 121 on the upper surface of the dielectric substrate.

The feeding pin 103 is fitted to the insertion hole 123 of the dielectric substrate 102 so that it passes through the dielectric substrate 102. A lower end (an end that protrudes from the lower surface of the dielectric substrate 102) of the feeding pin 103 is connected to a central conductor of a coaxial cable (not shown), and signals are transmitted from the antenna apparatus 101 to an external receiving circuit through the coaxial cable.

A planar antenna element 105 is provided above the upper surface of the dielectric substrate 102 at a predetermined distance therefrom so as to be parallel to the dielectric substrate 102. The antenna element 105 is formed of a rectangular metal plate (for example, a copper plate) having a smaller size than the dielectric substrate 102.

Legs 106 formed of a metal plate are provided in the vicinities of the corners of the antenna element 105 so as to extend toward the dielectric substrate 102, and the legs 106 are arranged so as to be symmetric with respect to the center of the antenna element 105. For example, the legs 106 are integrally formed with the antenna element 105 by bending portions of the antenna element 105.

The legs 106 may be substantially symmetric with respect to the center of the antenna element 105. The number and shape of the legs 106 are not limited thereto.

As shown in FIGS. 7 and 8, ends of the legs 106 facing the dielectric substrate 102 are fitted to the clearance holes 122 that are provided in the vicinities of the corresponding corners of the dielectric substrate 102, so that the legs 106 pass through the dielectric substrate 102 from the upper surface (a surface facing the antenna element 105) to the lower surface without being electrically connected to the dielectric substrate 102.

As described above, on the lower surface of the dielectric substrate 102, the conductive portions 125 surround the circumferences of the clearance holes 122, and portions (hereinafter, referred to as 'fixing portions 161') of the legs 106 that protrude from the lower surface of the dielectric substrate 102 are connected to the conductive portions 125 and are fixed thereto by, for example, soldering. The fixing portions 161 may be fixed so as not to come out from the clearance holes 122, and various methods other than soldering may be used to fix the fixing portions 161.

As described above, the chip capacitors 104 are provided so as to be connected to one end of each of the conductive portions 125 and the conductor layer 127, and the fixing portions 161 of the legs 106 are connected and fixed to the conductive portions 125. In this way, the fixing portions 161 are electrically connected to the conductor layer 127 of the dielectric substrate 102 through the chip capacitors 104 that are connected to the conductive portions 125.

Further, a feeding point 151 is provided at a position that slightly deviates from the center of the antenna element 105, and an upper end (an end that is not connected to the coaxial cable) of the feeding pin 103 passing through the dielectric substrate 102 is soldered to the feeding point 151.

Next, the operation of the antenna apparatus 101 according to this embodiment will be described below.

In the antenna apparatus 101 according to this embodiment of the invention, the ends of the plurality of legs 106 that are integrally formed with the antenna element 105 are fitted to the clearance holes 122 provided in the dielectric substrate 102, and portions (fixing portions 61) of the legs 106 protruding from the lower surface of the dielectric substrate 102 are soldered and fixed to the corresponding conductive portions 125 that are provided on the lower surface of the dielectric substrate 102 In this way, the fixing portions 161 are fixed to the dielectric substrate 102 without coming out from the clearance holes, and the fixing portions 161 of the legs 106 are electrically connected to the conductor layer 127 of the dielectric substrate 102 through the chip capacitors 104 that are provided at positions where they are connected to one end of each of the conductive portions 125 and the conductor layer 127.

Furthermore, the feeding pin 103 having one end that is connected to the central conductor of the coaxial cable is fitted to the insertion hole 123 of the dielectric substrate 102, and the other end (upper end) of the feeding pin 103 is soldered to the feeding point 151 of the antenna element 105. In this way, the feeding pin 103 passes through the dielectric substrate 102 and is connected to the antenna element 105, without being electrically connected to the dielectric substrate 102.

When a high-frequency signal is supplied to the antenna element 105 through the feeding pin 103, an electric field is formed, and a circularly polarized radio wave is radiated from the antenna element 105.

Meanwhile, when the antenna element 105 receives electric signals, the received electric signals are transmitted to an external receiving circuit through a low noise amplifier (LNA) or the coaxial cable.

As described above, according to this embodiment, the antenna apparatus 101 includes the antenna element 105 that is formed of a metal plate, such as a copper plate, and the dielectric substrate 102, but does not include a substrate formed of a high dielectric material, such as ceramic. Therefore, it is possible to reduce the number of parts and the overall weight of the antenna apparatus In addition, since the antenna apparatus does not use ceramic, which is a relatively expensive material, it is possible to reduce the manufacturing costs of the antenna apparatus.

Further, according to this embodiment of the invention, since the fixing portions 161 of the legs 106 are electrically connected to the dielectric substrate 102 through the chip capacitors 104, it is possible to easily ensure large capacitance without increasing the size of a substrate and providing a substrate formed of a high dielectric material, such as ceramic. As a result, it is possible to achieve an antenna apparatus having a small size and light weight.

In addition, since the antenna apparatus 101 includes the antenna element 104, it is possible to easily adjust a capacitance value.

Since the legs 106 are symmetric with respect to the center of the antenna element 105, the performance of the antenna apparatus is stabilized. In addition, since the chip capacitors 104 are provided so as to correspond to the legs 106, it is possible to ensure sufficient capacitance without using a high dielectric material such as ceramic. Since the chip capacitors 104 are symmetrically provided, the performance of the antenna apparatus is stabilized.

In this embodiment of the invention, the chip capacitors 104 are provided on the lower surface of the dielectric substrate 102, but the invention is not limited thereto. For example, the chip capacitors 104 may be provided on the upper surface (a surface facing the antenna element 105) of the dielectric substrate 102. In this case, each of the chip capacitors 104 may be arranged at a position where one end thereof is connected to the corresponding leg 106 and the other end is connected to the conductor layer 121, with the insulating portion 124 interposed therebetween. However, the position of the chip capacitor 104 is not limited thereto.

Furthermore, it is possible to adjust the reduction ratio of the size of the antenna apparatus 101 by adjusting the capacitances of the chip capacitors 104. However, the larger the capacitance of the chip capacitor 104 becomes, the lower the characteristic (gain) of the antenna apparatus becomes. Therefore, the capacitance of the chip capacitor 104 depends on required antenna characteristics (gain).

Fourth Embodiment

Hereinafter, a fourth embodiment of the invention will be described with reference to FIGS. 10 to 12. However, the scope of the invention is not limited thereto.

Figure 10:
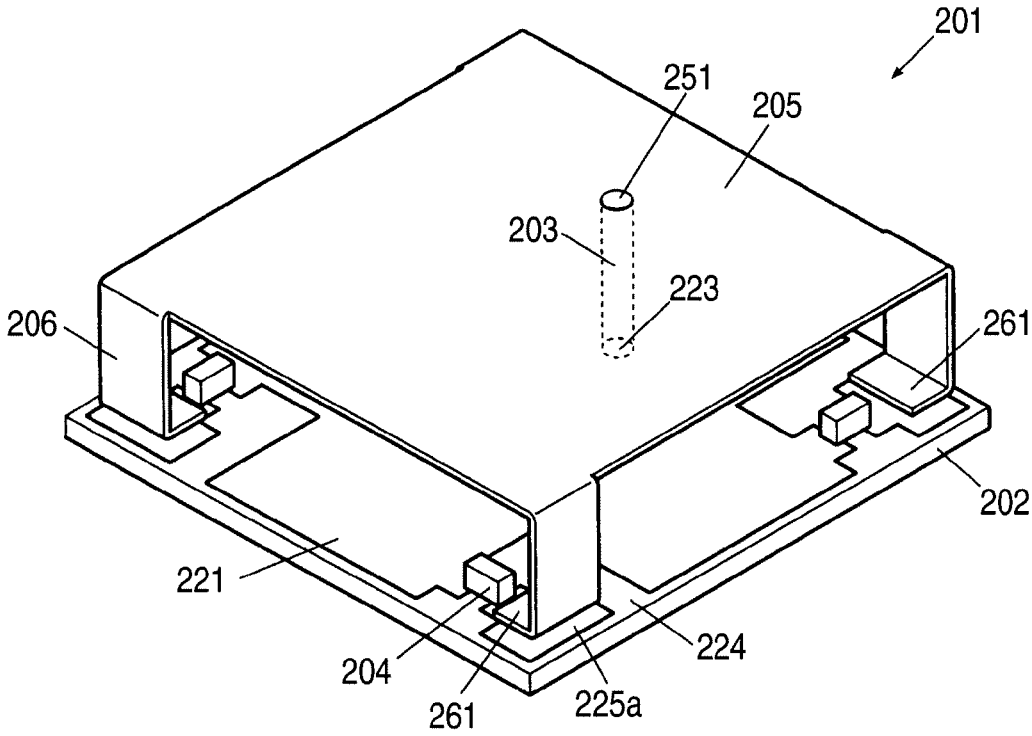
FIG. 10 is a perspective view illustrating an antenna apparatus according to a fourth embodiment of the invention.

FIG. 10 is a perspective view illustrating an antenna apparatus 201 according to the fourth embodiment of the invention. FIG. 11 is a side view illustrating the antenna apparatus 201 shown in FIG. 10. FIG. 12 is a cross-sectional view of the antenna apparatus 201, taken along the line A-A of FIG. 11.

Figure 11:
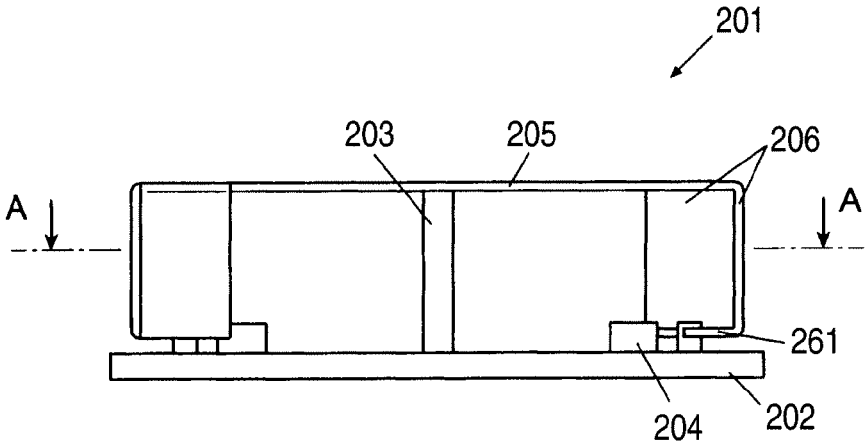
FIG. 11 is a side view illustrating the antenna apparatus shown in FIG. 10.

As shown in FIGS. 10 and 11, the antenna apparatus 201 includes a dielectric substrate 202 formed in a rectangular shape. Four conductive portions 225*a* are provided in the vicinities of four corners of the dielectric substrate 202 on one surface (an upper surface in FIG. 10; which is simply referred to as an 'upper surface') of the dielectric substrate 202. In addition, insulating portions 224 are provided in the peripheries of the conductive portions 225*a*, and the peripheries of the insulating portions 224 are covered with a conductor layer 221. An insertion hole 223 into which a feeding pin 203, which will be described later, is inserted is provided at a position that slightly deviates from the center of the dielectric substrate 202.

Figure 12:
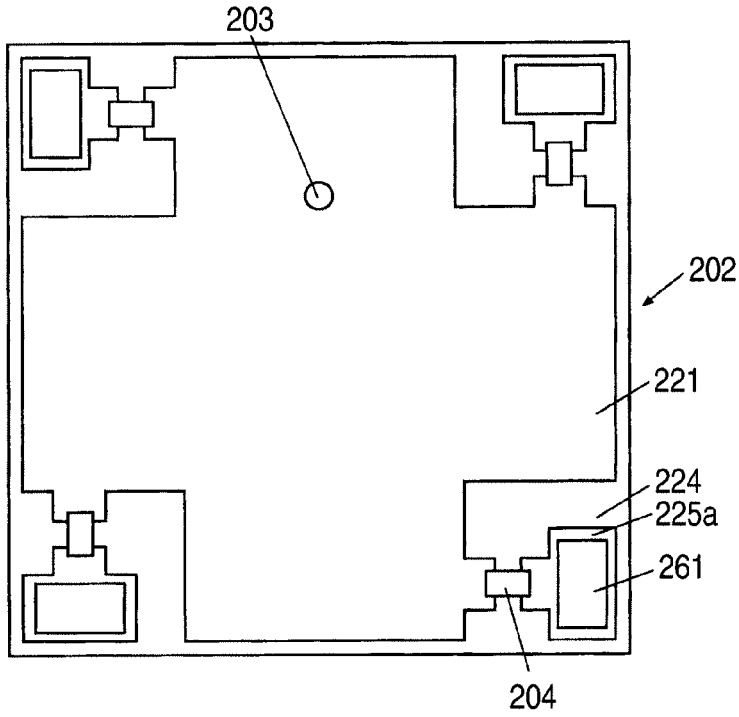
FIG. 12 is a cross-sectional view of the antenna apparatus taken along the line A-A of FIG. 11.

As shown in FIGS. 10 and 12, chip capacitors 204, serving as lumped-constant elements, are provided so as to be connected to one end of each of the corresponding conductive portions 225*a*. The chip capacitor 204 is arranged such that one end thereof is connected to the conductive portion 225*a* and the other end is connected to the conductor layer 221, with the insulating portion 224 interposed therebetween.

For example, the chip capacitor 204 is a laminated ceramic chip capacitor that is formed by interposing a dielectric material, such as ceramic, between metal plates, but the invention is not limited thereto. Any type of chip capacitor may be used as long as it has a small size and light weight. In addition, the chip capacitor 204 may be arranged at a position where one end thereof is connected to the conductive portion 225*a* and the other end is connected to the conductor layer 221, with the insulating portion 224 interposed therebetween. However, the position of the chip capacitor 204 is not limited thereto.

The feeding pin 203 is fitted to the insertion hole 223 of the dielectric substrate 202 so that it passes through the dielectric substrate 202. A lower end (an end that protrudes from the lower surface of the dielectric substrate 202) of the feeding pin 203 is connected to a central conductor of a coaxial cable (not shown), and signals are transmitted from the antenna apparatus 201 to an external receiving circuit through the coaxial cable.

A planar antenna element 205 is provided above the upper surface of the dielectric substrate 202 at a predetermined distance therefrom so as to be parallel to the dielectric substrate 202. The antenna element 205 is formed of a rectangular metal plate (for example, a copper plate) having a smaller size than the dielectric substrate 202.

Legs 206 formed of a metal plate are provided in the vicinities of the corners of the antenna element 205 so as to extend toward the dielectric substrate 202. For example, the legs 206 are integrally formed with the antenna element 205 by bending portions of the antenna element 205. However, the number and shape of the legs 206 are not limited thereto.

As shown in FIGS. 10 and 11, bent portions 261 that are bend inward to the antenna element 205 and face the conductive portions 225*a* are provided at the ends of the plurality of legs 206 facing the dielectric substrate 202. The bent portions 261 serve as electrodes, and the bent portions 261 and the conductive portions 225*a* formed on the dielectric substrate 202 are parallel to each other with a predetermined gap interposed therebetween.

Further, a feeding point 251 is provided at a position that slightly deviates from the center of the antenna element 205, and an upper end (an end that is not connected to the coaxial cable) of the feeding pin 203 passing through the dielectric substrate 202 is soldered to the feeding point 251.

Next, the operation of the antenna apparatus 201 according to this embodiment will be described below.

In the antenna apparatus 201 according to this embodiment of the invention, the bent portion 261 and the conductive portion 225*a* on the dielectric substrate 202 that faces the bent portion 261 are electromagnetically coupled to each other to form a capacitor.

The capacitor formed between the bent portion 261 and the conductive portion 225*a* makes it possible to obtain the effect of reducing a wavelength.

Further, the electromagnetic coupling between the bent portion 261 and the conductive portion 225*a* makes it possible to obtain a stable capacitance value, as compared to a coupling method according to the related art in which capacitance depends on the amount of solder during soldering.

Furthermore, it is possible to reduce a variation in capacitance or relative dielectric constant due to a material forming the dielectric substrate, as compared to a structure in which a substrate pattern is formed on the surface of the dielectric substrate facing the antenna element to increase the capacitance. Therefore, it is possible to prevent a variation in capacitance and thus obtain a stable capacitance value.

As described above, according to the antenna apparatus of this embodiment, capacitors are formed between the dielectric substrate and the bent portions that are provided at the ends of the legs extending from the antenna element. As a result, it is possible to obtain the effect of shortening a wavelength and reduce the size of an antenna apparatus.

Further, since soldering is not used to couple the dielectric substrate to the antenna element, it is possible to obtain a constant capacitance value and manufacture an antenna apparatus having a stable frequency characteristic.

Furthermore, it is possible to adjust the reduction ratio of the size of the antenna apparatus 201 by adjusting the capacitances of the chip capacitors 204. However, the larger the capacitance of the chip capacitor 204 becomes, the lower the characteristic (gain) of the antenna apparatus becomes. Therefore, the capacitance of the chip capacitor 204 depends on required antenna characteristics (gain).

Although the exemplary embodiment of the invention has been described above, the invention is not limited thereto, but various modifications and changes of the invention can be made without departing from the scope and spirit of the invention.

Fifth Embodiment

Next, a fifth embodiment of the invention will be described with reference to FIGS. 13 to 15.

Figure 13:
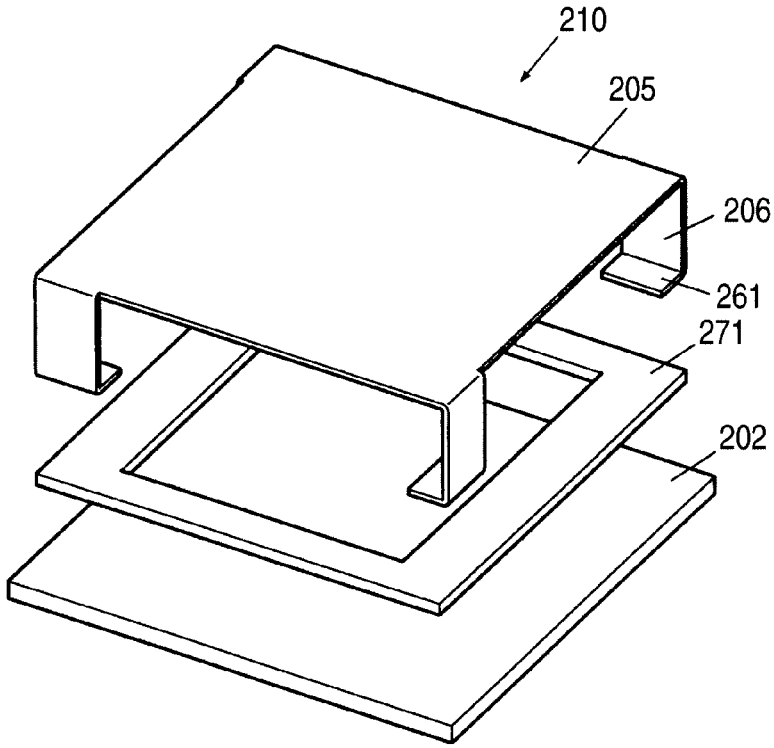
FIG. 13 is an exploded perspective view illustrating an antenna apparatus according to a fifth embodiment of the invention.
Figure 15:
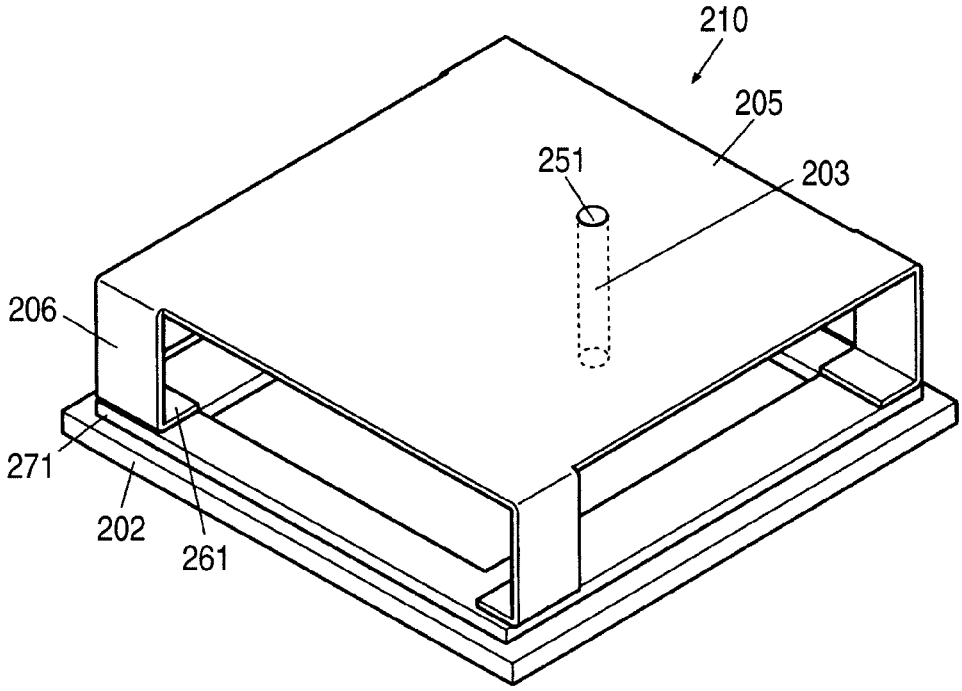
FIG. 15 is a perspective view illustrating the antenna apparatus according to the fifth embodiment of the invention.
Figure 16:
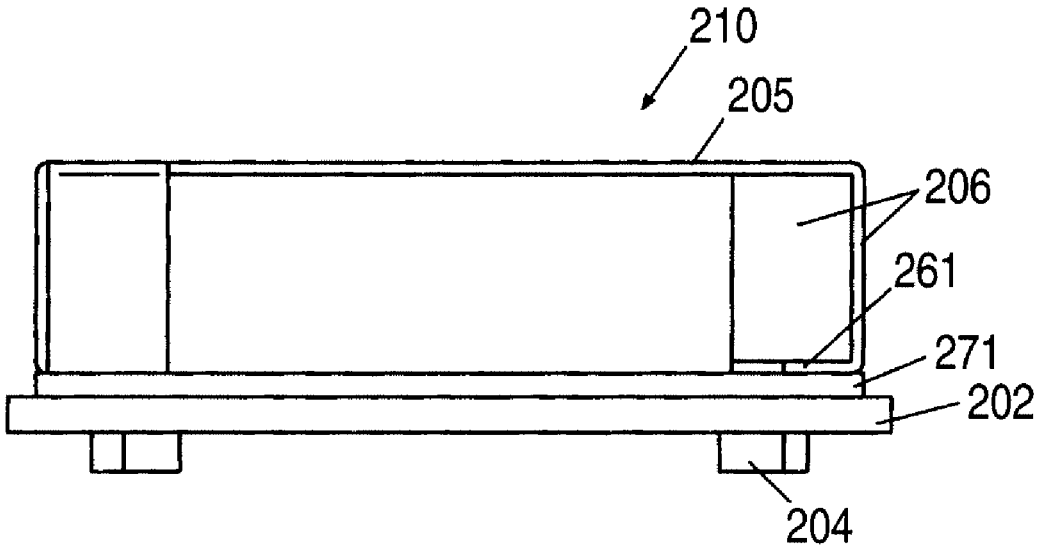
FIG. 16 is a side view illustrating the antenna apparatus shown in FIG. 15.

FIG. 13 is an exploded perspective view illustrating an antenna apparatus 210 according to the fifth embodiment of the invention. FIG. 14 is an exploded perspective view illustrating the antenna apparatus 210 shown in FIG. 13, as viewed from the bottom. FIG. 15 is a perspective view illustrating the antenna apparatus 210 according to this embodiment. FIG. 16 is a side view illustrating the antenna apparatus 210 shown in FIG. 15.

As shown in FIGS. 13 to 16, the antenna apparatus 210 according to this embodiment includes a dielectric substrate 202, an antenna element 205, and a holder 271 having a rectangular frame shape that is interposed between the dielectric substrate 202 and the antenna element 205. The antenna apparatus 210 according to this embodiment has the same basic structure as that in the fourth embodiment. Therefore, in this embodiment, the same components as those in the fourth embodiment are denoted by the same reference numerals, and thus a detailed description thereof will be omitted.

Figure 14:
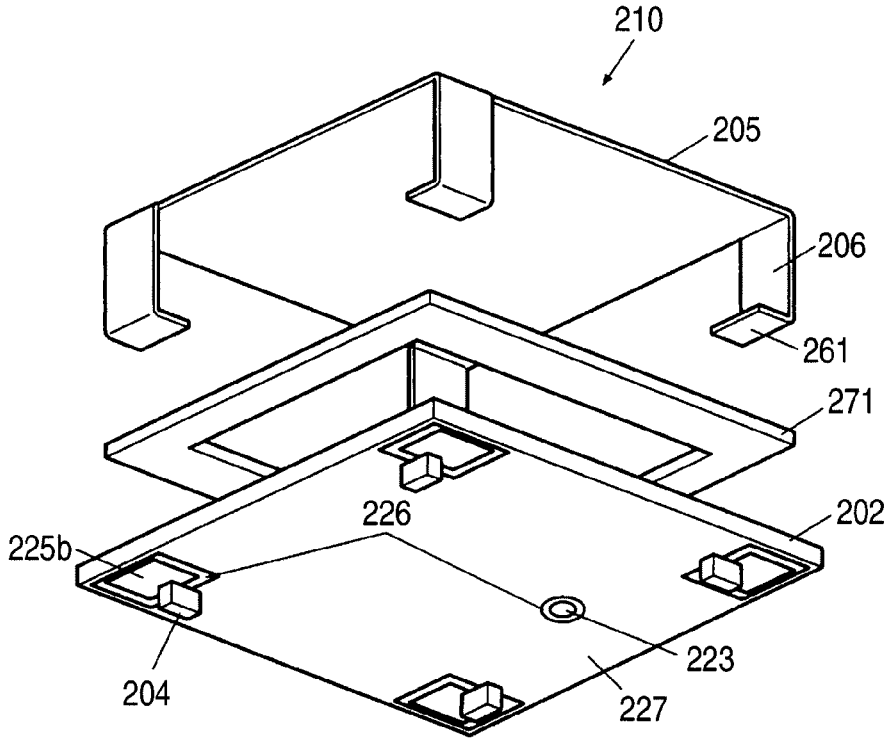
FIG. 14 is an exploded perspective view illustrating the antenna apparatus shown in FIG. 13, as viewed from the bottom.

As shown in FIG. 14, in the antenna apparatus 210 according to this embodiment, four conductive portions 225*b* are provided in the vicinities of four corners of a surface (a lower surface in FIG. 14; which is simply referred to as a 'lower surface') of the dielectric substrate 202 that does not face the antenna element 205. Insulating portions 226 are provided in the peripheries of the conductive portions 225*b* and the circumference of the insertion hole 223 so as to surround the conductive portions 225*b* and the insertion hole 223. In addition, the peripheries of the insulating portions 226 are covered with a conductor layer 227.

Further, chip capacitors 204, serving as lumped-constant elements, are provided so as to be connected to one end of each of the corresponding conductive portions 225*b*. The chip capacitor 204 is arranged such that one end thereof is connected to the conductive portion 225*b* and the other end is connected to the conductor layer 227, with the insulating portion 226 interposed therebetween.

The holder 271 having a rectangular frame shape is provided between the dielectric substrate 202 and bent portions 261 of the legs 206 extending from the antenna element 205. As shown in FIGS. 15 and 16, the bent portions 261 are fixed to the dielectric substrate 202 with the holder 271 interposed therebetween.

The holder 271 is formed so as to have substantially the same size as the antenna element 205, and has a sufficient width for the bent portions 261 to be fixed. The holder 271 is formed of a dielectric resin, such as ABS, but the invention is not limited thereto. For example, any type of material can be used as long as it has a dielectric constant.

Next, the operation of the antenna apparatus according to the fifth embodiment will be described below.

In the antenna apparatus 210 having the above-mentioned structure, the holder 271 formed of a dielectric resin is provided between the dielectric substrate 202 and the bent portions 261.

In this way, the antenna element 205 is hold on the dielectric substrate 202 by the holder 271 as well as the feeding pin 203, which makes it possible to reinforce the structural strength of the antenna element 205 mounted on the dielectric substrate 202.

Further, since the holder 271 is formed of a dielectric resin, the holder 271 can serve as a dielectric material of the capacitors that are formed between the bent portions 261 and the dielectric substrate 202, which results in an increase in capacitance.

As described above, according to the antenna apparatus of the fifth embodiment, since the bent portions of the legs are fixed by the holder, it is possible to improve the overall strength of the antenna apparatus.

Further, it is possible to increase the capacitance and thus improve the effect of shortening a wavelength in addition to improving the overall strength of the antenna apparatus, without increasing the size of the dielectric substrate. As a result, it is possible to manufacture a small antenna apparatus.

Sixth Embodiment

Hereinafter, a sixth embodiment of the invention will be described with reference to FIGS. 17 to 20. However, the scope of the invention is not limited thereto.

Figure 17:
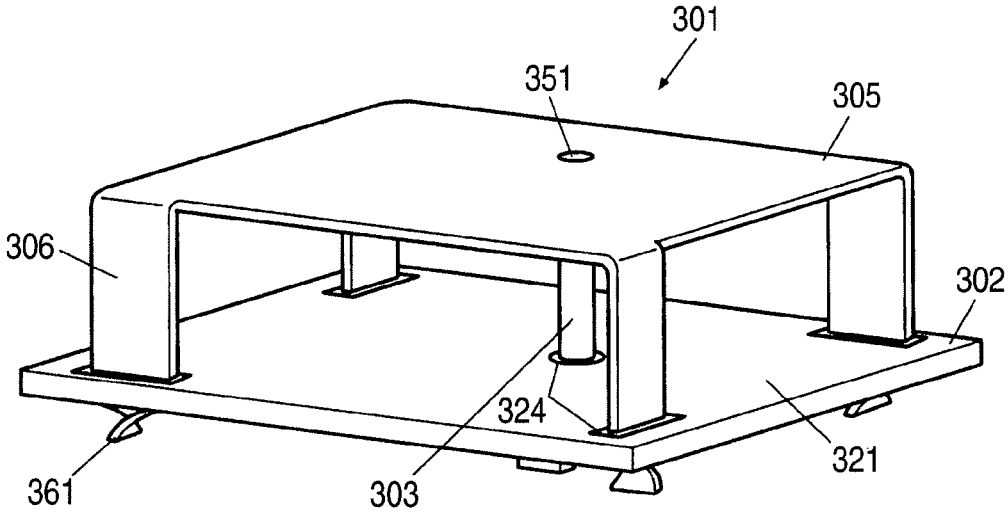
FIG. 17 is a perspective view illustrating an antenna apparatus according to a sixth embodiment of the invention.
Figure 18:
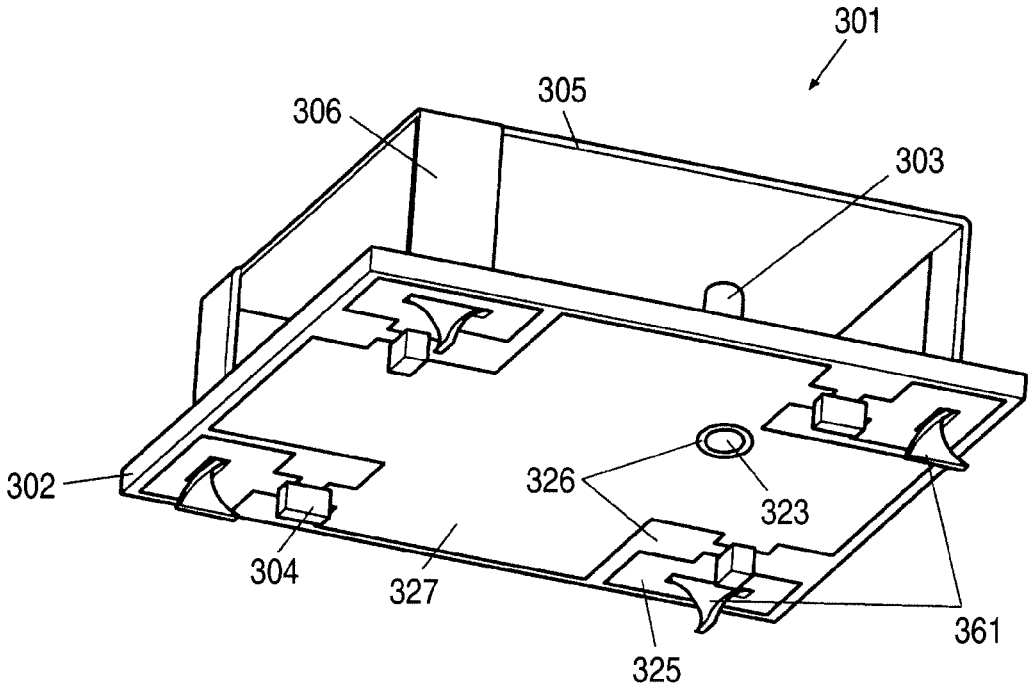
FIG. 18 is a perspective view illustrating the antenna apparatus shown in FIG. 17, as viewed from the bottom.
Figure 19:
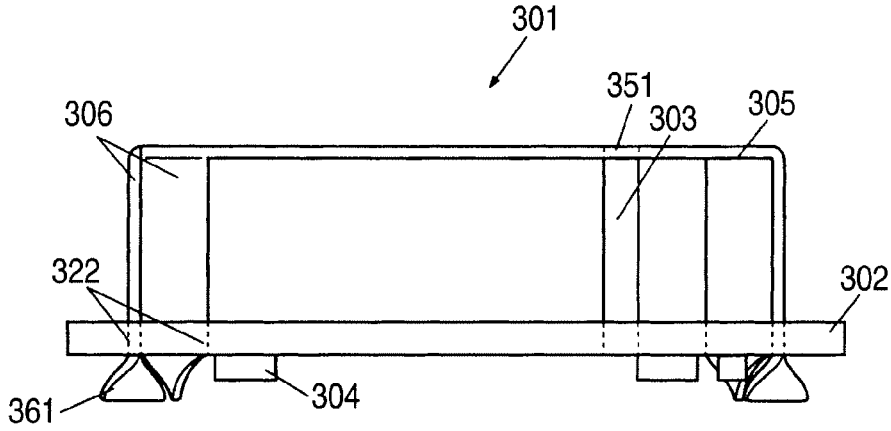
FIG. 19 is a side view of the antenna apparatus shown in FIG. 17.
Figure 20:
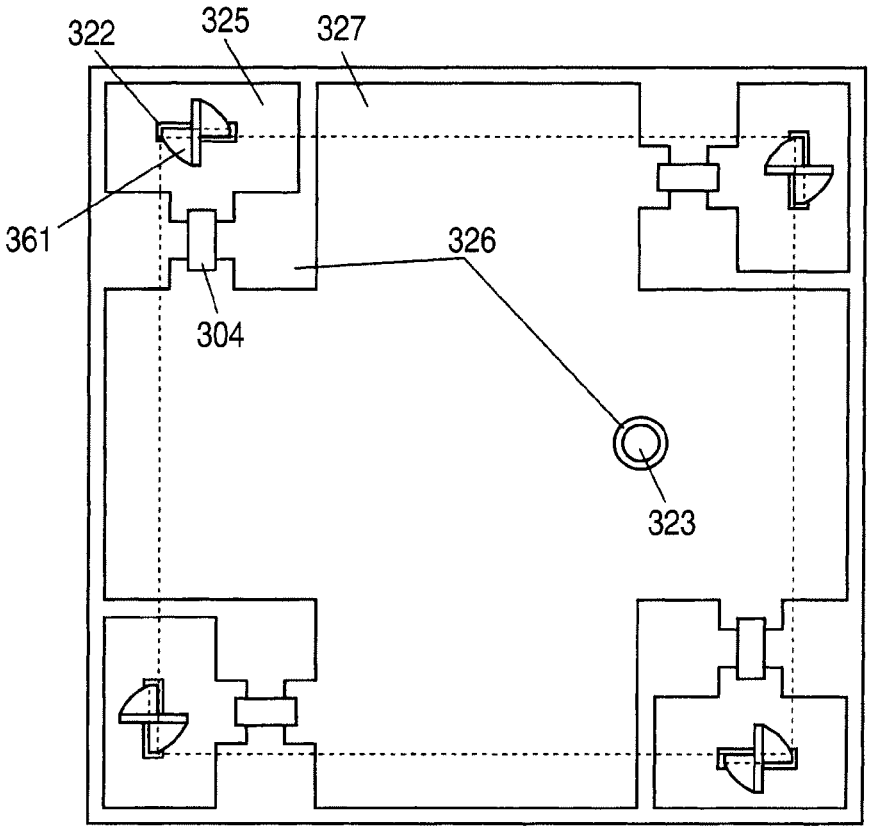
FIG. 20 is a bottom view illustrating the antenna apparatus shown in FIG. 17.

FIG. 17 is a perspective view illustrating an antenna apparatus 301 according to the sixth embodiment of the invention. FIG. 18 is a perspective view illustrating the antenna apparatus 301 shown in FIG. 17, as viewed from the bottom. FIG. 19 is a side view of the antenna apparatus 301 shown in FIG. 17. FIG. 20 is a bottom view illustrating the antenna apparatus 301 shown in FIG. 17.

As shown in FIGS. 17 and 18, the antenna apparatus 301 includes a dielectric substrate 302 having conductor layers 321, such as copper-clad films, on both surfaces. The dielectric substrate 302 is formed in a rectangular shape, and four clearance holes 322 are provided in the vicinities of four corners of the dielectric substrate 302. An insertion hole 323 into which a feeding pin 303, which will be described later, is inserted is provided at a position that slightly deviates from the center of the dielectric substrate 302.

Insulating portions 324 are provided in the circumferences of the clearance holes 322 and the insertion hole 323 on one surface (an upper surface in FIG. 17; which is simply referred to as an 'upper surface') of the dielectric substrate 302, and the clearance holes 322 and the insertion hole 323 are insulated from the conductor layer 321. Meanwhile, as shown in FIGS. 18 and 20, conductive portions 325 are provided in the circumferences of the corresponding clearance holes 322 on the other surface (a lower surface in FIG. 17; which is simply referred to as a 'lower surface') of the dielectric substrate 302 so as to surround the clearance holes 322. Insulating portions 326 are provided in the peripheries of the conductive portions 325 and the circumference of the insertion hole 323 so as to surround the conductive portions 325 and the insertion hole 323. The peripheries of the insulting portions 326 are covered with a conductor layer 327, and a circuit element, such as a low noise amplifier (LNA) (not shown), is mounted on the conductor layer 327.

As shown in FIGS. 18 and 20, chip capacitors 304, serving as lumped-constant elements, are provided on the lower surface of the dielectric substrate 302 so as to be connected to one end of each of the corresponding conductive portions 325. The chip capacitor 304 is arranged such that one end thereof is connected to the conductive portion 325 and the other end is connected to the conductor layer 327, with the insulating portion 326 interposed therebetween.

For example, the chip capacitor 304 is a laminated ceramic chip capacitor formed by interposing a dielectric material, such as ceramic, between metal plates, but the invention is not limited thereto. Any type of chip capacitor can be used as long as it has a small size and light weight. In addition, the chip capacitor 304 may be arranged at a position where one end thereof is connected to the conductive portion 325 and the other end is connected to the conductor layer 327, with the insulating portion 326 interposed therebetween. However, the position of the chip capacitor 304 is not limited thereto.

A feeding pin 303 is inserted into the insertion hole 323 of the dielectric substrate 302 so that it passes through the dielectric substrate 302. A lower end (an end that protrudes from the lower surface of the dielectric substrate 302) of the feeding pin 303 is connected to a central conductor of a coaxial cable (not shown), and signals are transmitted from the antenna apparatus 301 to an external receiving circuit through the coaxial cable.

A planar antenna element 305 is provided above the upper surface of the dielectric substrate 302 at a predetermined distance therefrom so as to be parallel to the dielectric substrate 302. The antenna element 305 is formed of a rectangular metal plate (for example, a copper plate) having a smaller size than the dielectric substrate 302.

Legs 306 formed of a metal plate are provided in the vicinities of the corners of the antenna element 305 so as to extend toward the dielectric substrate 302. The legs 306 are integrally formed with the antenna element 305 by bending portions of the antenna element 305. The number and shape of the legs 306 are not limited thereto.

As shown in FIGS. 18 and 19, ends of the legs 306 facing the dielectric substrate 302 are fitted to the clearance holes 322 that are provided in the vicinities of the corresponding corners of the dielectric substrate 302, so that the legs 306 pass through the dielectric substrate 302 from the upper surface (a surface facing the antenna element 305) to the lower surface without being electrically connected to the dielectric substrate 302.

As described above, on the lower surface of the dielectric substrate 302, the conductive portions 325 surround the circumferences of the clearance holes 322, and portions (hereinafter, referred to as 'fixing portions 361') of the legs 306 that protrude from the lower surface of the dielectric substrate 302 are connected to the conductive portions 325 and are fixed thereto so as not to come off from the clearance holes 322.

As shown in FIG. 20, each of the fixing portion 361 is twisted at an angle of about 90° on an axis in the longitudinal direction of the leg, which passes through the center of the leg in the width direction, so that the dielectric substrate 302 is integrally formed with the antenna element 305.

The peripheries of the fixing portions 361 are surrounded by the conductive portions 325, and the fixing portions 361 and the conductive portions 325 are electrically connected to each other.

Figure 21A:
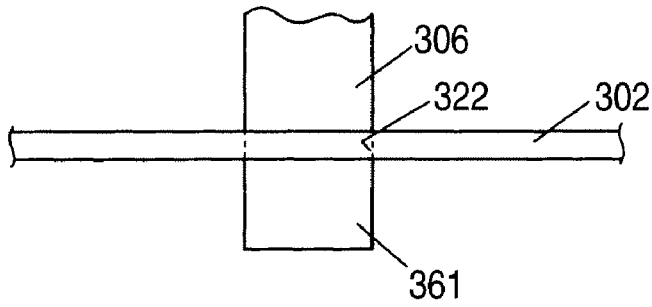
FIG. 21A is a front view illustrating a leg of the antenna apparatus according to the sixth embodiment of the invention.
Figure 21B:
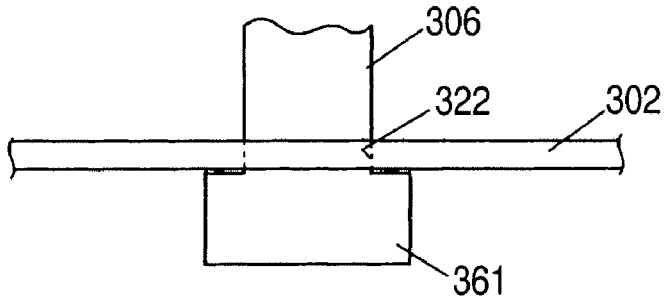
FIG. 21B is a front view illustrating a leg of an antenna apparatus according to a modification of the sixth embodiment of the invention.

As shown in FIG. 21B, the fixing portion 361 may be formed in a shape in which the width thereof is larger than that of the leg 306.

Figure 21C:
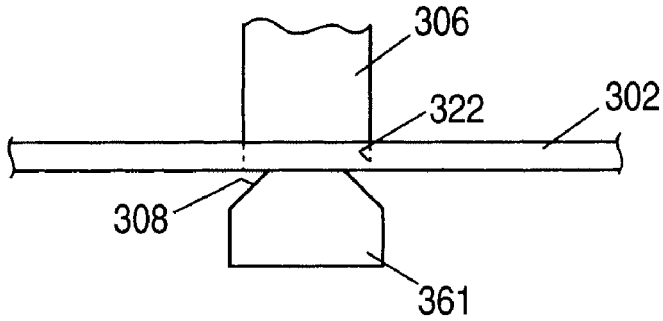
FIG. 21C is a front view illustrating a leg of an antenna apparatus according to another modification of the sixth embodiment of the invention.

Alternatively, as shown in FIG. 21C, cut-out portions 308 may be formed in the fixing portion 361 such that the fixing portion 361 is fixed to the rear surface of the dielectric substrate 302 using the cut-out portions 308 as fixing points.

As described above, the chip capacitors 304 are provided so as to be connected to one end of each of the conductive portions 325 and the conductor layer 327, and the fixing portions 361 of the legs 306 are connected and fixed to the conductive portions 325. In this way, the fixing portions 361 are electrically connected to the conductor layer 327 of the dielectric substrate 302 by the chip capacitors 304 that are connected to the conductive portions 325.

Further, a feeding point 351 is provided at a position that slightly deviates from the center of the antenna element 305, and an upper end (an end that is not connected to the coaxial cable) of the feeding pin 303 passing through the dielectric substrate 302 is soldered to the feeding point 351.

Next, the operation of the antenna apparatus according to this embodiment will be described below.

In the antenna apparatus 301 having the above-mentioned structure, the ends of the plurality of legs 306 that are integrally formed with the antenna element 305 are fitted to the clearance holes 322 provided in the dielectric substrate 302, and portions (fixing portions 361) of the legs 306 protruding from the lower surface of the dielectric substrate 302 are twisted such that the fixing portions 361 do not come off from the clearance holes 322. In this way, the dielectric substrate 302 and the antenna element 305 are coupled to each other with predetermined mechanical strength. This coupling makes it possible to prevent an increase in the number of parts.

In this case, the width of the fixing portion 361 passing through the dielectric substrate 302 is larger than the width of the leg 306, and the fixing portion 361 does not come off from the clearance hole 322, which makes it possible to improve mechanical strength. In addition, since the width of the fixing portion 361 is large, it is easy to fix the fixing portion 361, which makes it possible to easily manufacture an antenna apparatus.

When the cut-out portions 308 are provided in the fixing portion 361, the fixing portion 361 is easily twisted while the distance between the dielectric substrate 302 and the antenna element 305 is kept constant, which makes it easy to manufacture an antenna apparatus.

The coupling between the dielectric substrate 302 and the antenna element 305 makes it possible to prevent a variation in capacitance depending on the amount of solder and thus to obtain a constant capacitance value, as compared to a coupling method, such as soldering.

In this embodiment, since the fixing portions 361 and the dielectric substrate 302 are electrically connected to each other by the chip capacitors 304, it is possible to easily obtain large capacitance without increasing the size of a substrate.

In addition, since the chip capacitors 304 are provided, it is easy to adjust the capacitance value.

Furthermore, the feeding pin 303 having one end connected to the central conductor of the coaxial cable is fitted to the insertion hole 323 of the dielectric substrate 302, and the other end (upper end) of the feeding pin 303 is soldered to the feeding point 351 of the antenna element 305. In this way, the feeding pin 303 passes through the dielectric substrate 302 and is connected to the antenna element 305, without being electrically connected to the dielectric substrate 302.

When a high-frequency signal is supplied to the antenna element 305 through the feeding pin 303, an electric field is formed, and a circularly polarized radio wave is radiated from the antenna element 305.

Meanwhile, when the antenna element 305 receives electric signals, the received electric signals are transmitted to an external receiving circuit through a low noise amplifier (LNA) or the coaxial cable.

As described above, according to the antenna apparatus of this embodiment, the coupling between the dielectric substrate and the antenna element makes it possible to prevent a variation in capacitance and thus to obtain a constant capacitance value. As a result, it is possible to manufacture an antenna apparatus having a stable frequency characteristic.

In addition, since the dielectric substrate and the antenna element are coupled to each other without increasing the number of parts, it is possible to manufacture an inexpensive antenna apparatus.

Further, it is possible to shorten a wavelength without increasing the size of the dielectric substrate, and thus manufacture a small antenna apparatus.

In the above-described embodiment, the chip capacitors 304 are provided on the lower surface of the dielectric substrate 302, but the invention is not limited thereto. For example, the chip capacitors 304 may be provided on the upper surface (a surface facing the antenna element 305) of the dielectric substrate 302. In this case, each of the chip capacitors 304 may be arranged at a position where one end thereof is connected to the corresponding leg 306 and the other end is connected to the conductor layer 321, with the insulating portion 324 interposed therebetween. However, the position of the chip capacitor 304 is not limited thereto.

Furthermore, it is possible to adjust the reduction ratio of the size of the antenna apparatus 301 by adjusting the capacitances of the chip capacitors 304. However, the larger the capacitance of the chip capacitor 304 becomes, the lower the characteristic (gain) of the antenna apparatus becomes. Therefore, the capacitance of the chip capacitor 304 depends on required antenna characteristics (gain).

Although some exemplary embodiments of the invention have been described above, the invention is not limited thereto, but various modifications and changes of the invention can be made without departing from the scope and spirit of the invention.

What is claimed is:

1. An antenna apparatus comprising:

a circuit board that has a main surface and a rear surface opposite to each other;

an antenna element that is formed of a metal plate and is arranged at a predetermined distance from the main surface of the circuit board;

a plurality of legs that extend from the antenna element toward the circuit board;

a ground conductor that is formed on the main surface or the rear surface of the circuit board;

a feeding pin that supplies power from the circuit board to the antenna element; and a plurality of comb-shaped capacitor patterns that are formed on one of or both the main surface and the rear surface of the circuit board and are electrically connected between the plurality of legs and the ground conductor, wherein the circuit board includes a plurality of conductive portions that are formed on one of or both the main surface and the rear surface and are connected to the corresponding legs, and each of the plurality of comb-shaped capacitor patterns is arranged such that one end thereof is connected to the conductive portion and the other end is electrically connected to the ground conductor, with an insulating portion interposed there between.

2. The antenna apparatus according to claim 1, wherein the plurality of legs are arranged so as to be symmetric with respect to a center of the antenna element, and the plurality of comb-shaped capacitor patterns are provided so as to correspond to the plurality of legs.

3. The antenna apparatus according to claim 1, wherein the ground conductor is formed on the main surface of the circuit board, and a low noise amplifier is formed on the rear surface of the circuit board.

4. The antenna apparatus according to claim 1, wherein the plurality of comb-shaped capacitor patterns are formed on both the main surface and the rear surface of the circuit board.

5. The antenna apparatus according to claim 1, wherein the plurality of comb-shaped capacitor patterns are formed on the rear surface of the circuit board.

6. The antenna apparatus according to claim 1, wherein each of the plurality of comb-shaped capacitor patterns includes first and second comb-shaped patterns that are opposite to each other with the insulating portion interposed there between the first comb-shaped pattern is connected to the conductive portion at the one end of the comb-shaped capacitor pattern, and the second comb-shaped pattern is electrically connected to the ground conductor at the other end of the comb-shaped capacitor pattern.

* * * * *